US012448967B2

(12) United States Patent
Sogawa et al.

(10) Patent No.: US 12,448,967 B2
(45) Date of Patent: Oct. 21, 2025

(54) VARIABLE DISPLACEMENT OIL PUMP

(71) Applicant: Hitachi Astemo, Ltd., Hitachinaka (JP)

(72) Inventors: Nobuaki Sogawa, Hitachinaka (JP); Koji Saga, Hitachinaka (JP); Daisuke Kato, Hitachinaka (JP)

(73) Assignee: Hitachi Astemo, Ltd., Hitachinaka (JP)

( * ) Notice: Subject to any disclaimer, the term of this patent is extended or adjusted under 35 U.S.C. 154(b) by 0 days.

(21) Appl. No.: 18/683,837

(22) PCT Filed: Jul. 5, 2022

(86) PCT No.: PCT/JP2022/026651
§ 371 (c)(1),
(2) Date: Feb. 15, 2024

(87) PCT Pub. No.: WO2023/037736
PCT Pub. Date: Mar. 16, 2023

(65) Prior Publication Data

US 2024/0369060 A1 Nov. 7, 2024

(30) Foreign Application Priority Data

Sep. 8, 2021 (JP) ..... 2021-145848

(51) Int. Cl.
*F04C 14/22* (2006.01)
*F04C 2/34* (2006.01)
(Continued)

(52) U.S. Cl.
CPC ..... *F04C 15/0065* (2013.01); *F04C 2/3442* (2013.01); *F04C 14/22* (2013.01);
(Continued)

(58) Field of Classification Search
CPC ..... F04C 14/226; F04C 14/223; F04C 14/22; F04C 2/344; F04C 15/0065
See application file for complete search history.

(56) References Cited

U.S. PATENT DOCUMENTS 5,518,380 A 5/1996 Fujii et al.
6,155,797 A 12/2000 Kazuyoshi
(Continued)

FOREIGN PATENT DOCUMENTS

JP 4-17791 A 1/1992
JP 7-243385 A 9/1995
(Continued)

OTHER PUBLICATIONS

English JP 2004150442 by PE2E Sep. 9, 2024.*
(Continued)

*Primary Examiner* — Deming Wan
(74) *Attorney, Agent, or Firm* — Crowell & Moring LLP

(57) ABSTRACT

In a variable displacement oil pump (VP1) according to the present invention, a coil spring (SP) as an urging member is arranged at a position that does not overlap a first suction port (114), a first discharge port (115) and an inlet (124*a*) which correspond to a suction portion when viewed from an axial direction along a drive shaft (2). Therefore, in the variable displacement oil pump (VP1), there is no risk that during pump operation, flow of oil introduced into the pump chambers 30 located in a suction region through the first suction port (114), the first discharge port (115) and the inlet (124*a*) corresponding to the suction portion will be interrupted by the coil spring (SP). With this, in the variable displacement oil pump (VP1), a suction resistance during the pump operation is reduced, then a suction performance of the pump can be improved.

11 Claims, 17 Drawing Sheets

(51) Int. Cl.
*F04C 2/344* (2006.01)
*F04C 15/00* (2006.01)

(52) U.S. Cl.
CPC ..... *F04C 14/223* (2013.01); *F04C 14/226* (2013.01); *F04C 15/0003* (2013.01); *F04C 2210/206* (2013.01); *F04C 2240/30* (2013.01)

(56) References Cited

U.S. PATENT DOCUMENTS

| | | | | |
|---|---|---|---|---|
| 2009/0291000 | A1 | 11/2009 | Saga et al. | |
| 2016/0290335 | A1* | 10/2016 | Cuneo | F04C 14/24 |
| 2019/0219053 | A1 | 7/2019 | Naganuma et al. | |
| 2019/0293069 | A1 | 9/2019 | Cuneo | |

FOREIGN PATENT DOCUMENTS

| | | | | | |
|---|---|---|---|---|---|
| JP | 2000-87877 | A | | 3/2000 | |
| JP | 2004150442 | A | * | 5/2004 | F04C 14/226 |
| JP | 2009-167816 | A | | 7/2009 | |
| JP | 2009-281271 | A | | 12/2009 | |
| JP | 2016-104968 | A | | 6/2016 | |
| JP | 2016-156367 | A | | 9/2016 | |
| JP | 2018-44523 | A | | 3/2018 | |
| JP | 2019-531438 | A | | 10/2019 | |

OTHER PUBLICATIONS

International Search Report (PCT/ISA/210) issued in PCT Application No. PCT/JP2022/026651 dated Sep. 6, 2022 with English translation (7 pages) International Preliminary Report on Patentability (PCT/IB/326, PCT/IB/338 & PCT/IB/373).
issued in PCT Application No. PCT/JP2022/026651 dated Mar. 21, 2024 including Japanese-language Written Opinion (PCT/ISA/237) with English translation (13 pages).
Japanese-language Office Action issued in Japanese Application No. 2023-546798 dated May 7, 2025 with English translation (6 pages).

* cited by examiner

VARIABLE DISPLACEMENT OIL PUMP

TECHNICAL FIELD

The present invention relates to a variable displacement oil pump.

BACKGROUND ART

As a conventional variable displacement oil pump, for instance, there is known a variable displacement oil pump disclosed in the following Patent Document 1.

In the variable displacement oil pump disclosed in the Patent Document 1, a cam ring is constantly forced in a direction in which an eccentric amount is increased by an urging force of a coil spring as an urging member through an arm portion that extends to an outer side of the cam ring.

CITATION LIST

Patent Document

Patent Document 1: Japanese Unexamined Patent Application Publication No. 2016-104968

SUMMARY OF THE INVENTION

Technical Problem

In the case of the conventional variable displacement oil pump, however, the arm portion of the cam ring and the coil spring are arranged so as to overlap a suction portion that sucks oil into an inside of a pump housing. Because of this, there is room for improvement in that the arm portion of the cam ring and the coil spring cause increase in suction resistance then this reduces a suction performance of the pump.

The present invention was made in view of the above technical problem of the conventional variable displacement oil pump. An object of the present invention is therefore to provide a variable displacement oil pump that is capable of improving the suction performance of the pump.

Solution to Problem

As one of aspects of the present invention, an urging member forcing an adjusting member in a direction in which an eccentric amount of the adjusting member from a rotation center of a drive shaft increases is provided between a pump accommodating portion and the adjusting member and located at a position that faces the drive shaft in a radial direction and that does not overlap a suction portion when viewed from an axial direction along the drive shaft.

Effects of Invention

According to the present invention, it is possible to reduce the suction resistance.

BRIEF DESCRIPTION OF THE DRAWINGS

FIG. 8A shows a pump state of a section a in FIG. 7. FIG. 8B shows a pump state of a section b in FIG. 7.

FIG. 9A shows a pump state of a section c in FIG. 7. FIG. 9B shows a pump state of a section d in FIG. 7.

FIG. 10A shows a pump state of a section e in FIG. 7. FIG. 10B shows a pump state of a section f in FIG. 7.

FIG. 12A shows a pump state of a section a in FIG. 7. FIG. 12B shows a pump state of a section b in FIG. 7.

FIG. 13A shows a pump state of a section c in FIG. 7. FIG. 13B shows a pump state of a section d in FIG. 7.

FIG. 14A shows a pump state of a section e in FIG. 7. FIG. 14B shows a pump state of a section f in FIG. 7.

EMBODIMENTS FOR CARRYING OUT THE INVENTION

Embodiments of a variable displacement oil pump according to the present invention will be described below with reference to the drawings. The following embodiments show an example in which the variable displacement oil pump is applied as an oil pump that supplies lubricating oil of an internal combustion engine to sliding parts of the vehicle internal combustion engine and a valve timing control device that controls opening/closing timing of engine valves. In the following description, for the sake of convenience in description, a direction along a rotation axis of a drive shaft 2 is referred to as an "axial direction", a direction orthogonal to the rotation axis of the drive shaft 2 is referred to as a "radial direction", and a rotation direction of the drive shaft 2 is referred to as a "circumferential direction".

First Embodiment

FIGS. 1 to 8 show a variable displacement oil pump VP1 according to a first embodiment of the present invention. FIGS. 1 to 6 are drawings illustrating a configuration of the variable displacement oil pump VP1. FIGS. 7 to 10 are drawings for describing variable displacement control of the variable displacement oil pump VP1.

(Configuration of Oil Pump)

Figure 1:
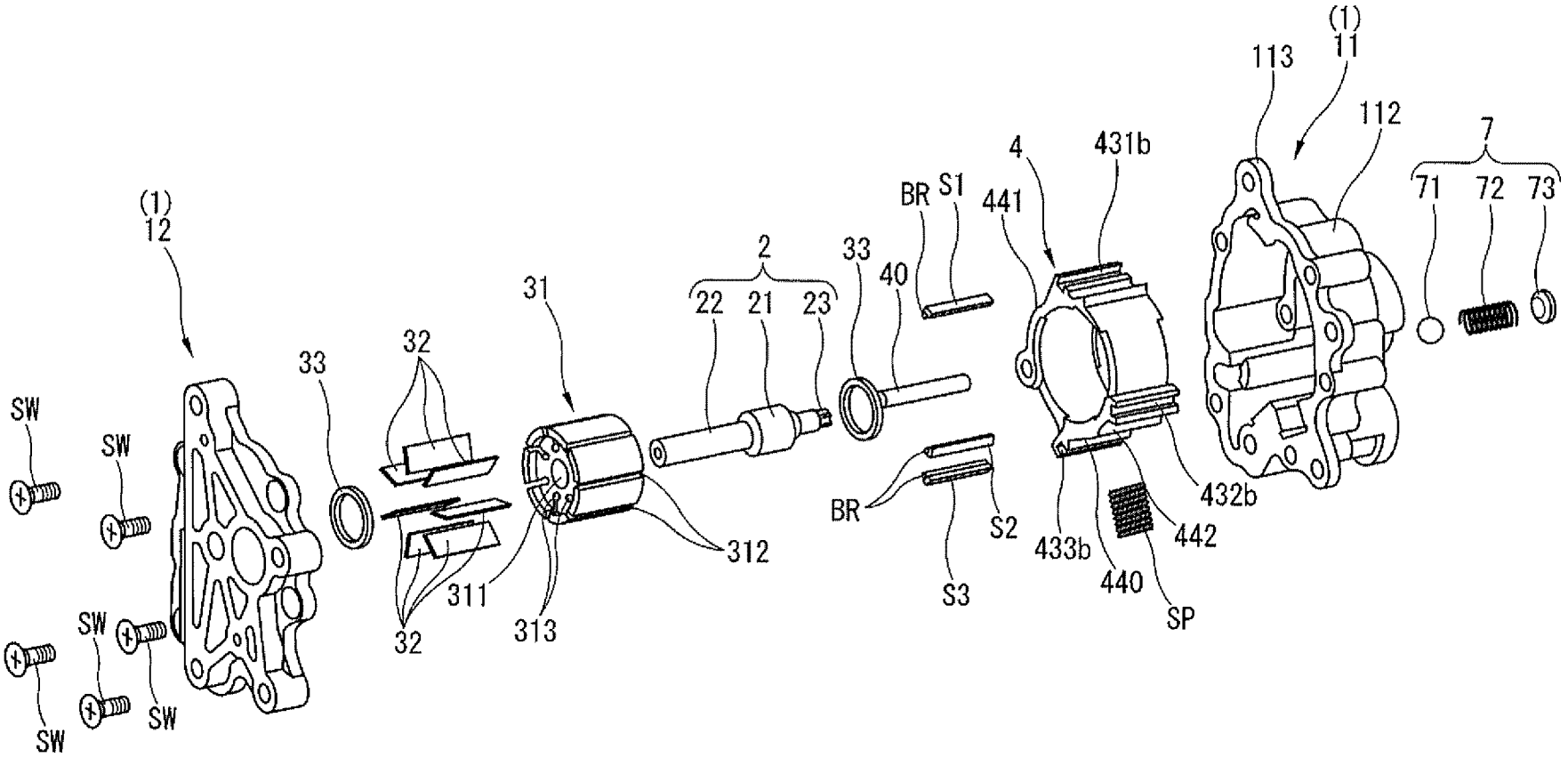
FIG. 1 is an exploded perspective view of a variable displacement oil pump according to a first embodiment of the present invention.
Figure 2:
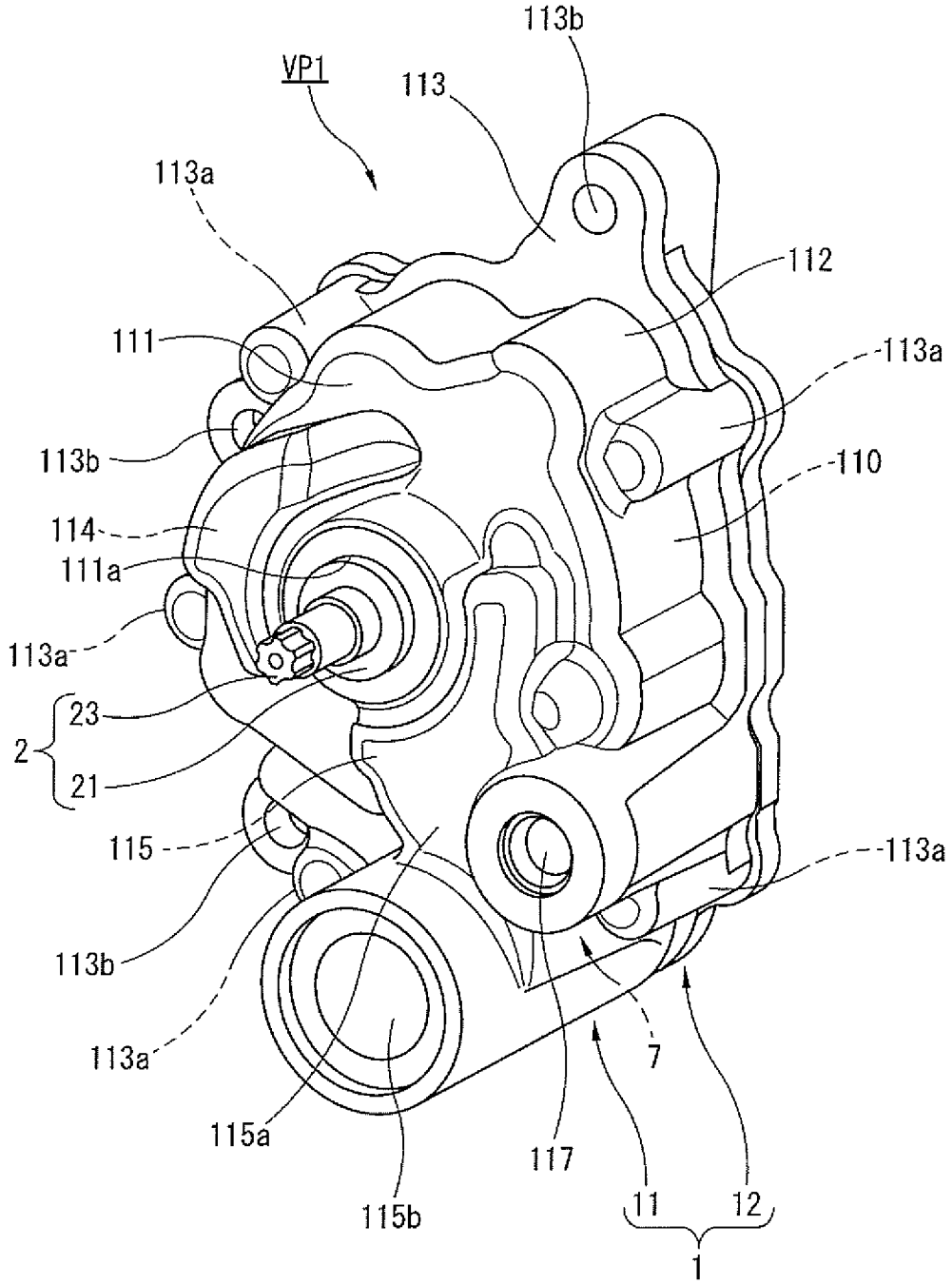
FIG. 2 is a perspective view of the variable displacement oil pump shown in FIG. 1, viewed from its front side.
Figure 3:
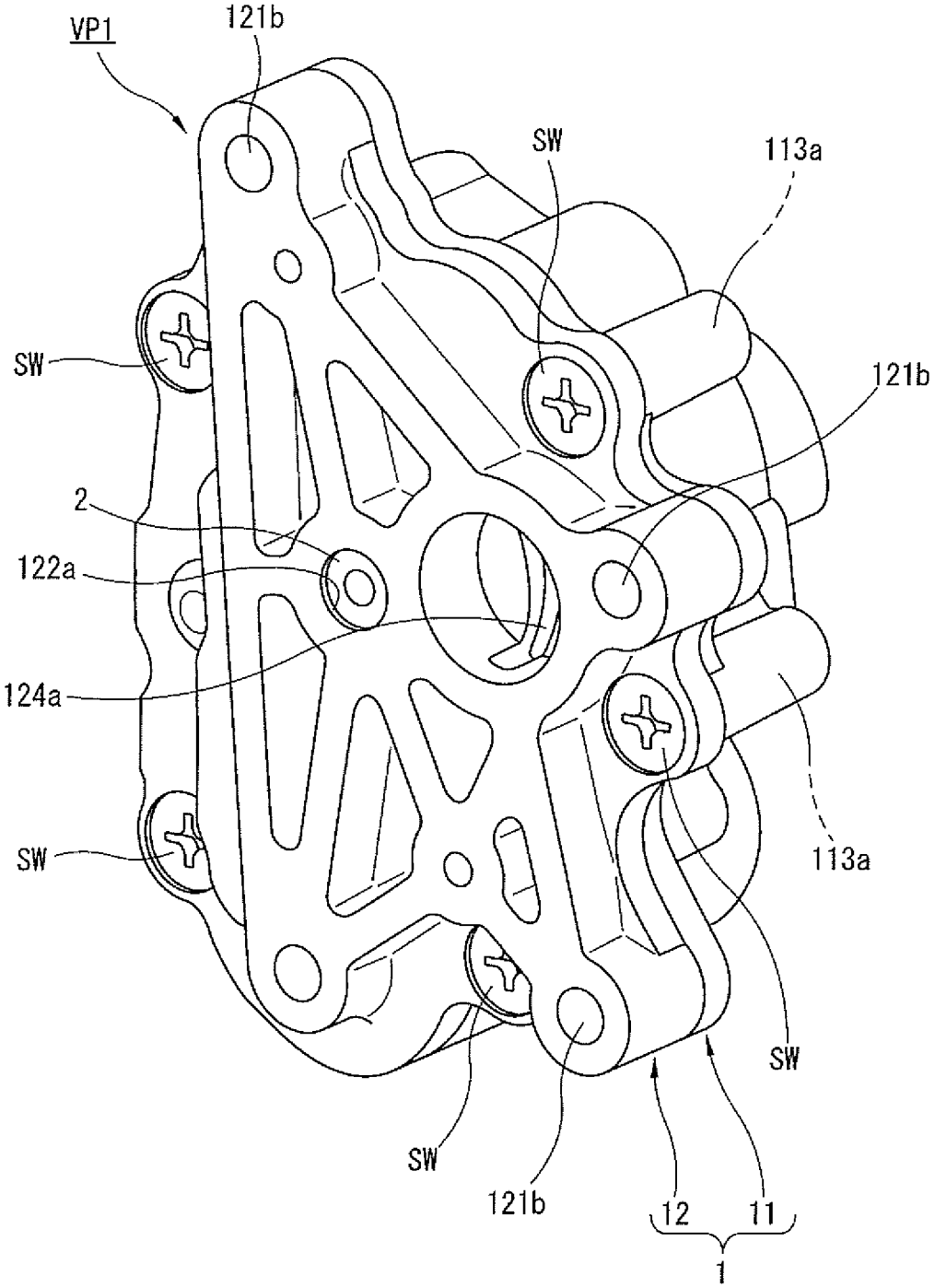
FIG. 3 is a perspective view of the variable displacement oil pump shown in FIG. 1, viewed from its back side.

As illustrated in FIG. 1, the variable displacement oil pump VP1 has the drive shaft 2, a pump member 3 driven and rotated by the drive shaft 2, a cam ring 4 corresponding to an adjusting member that is provided at an outer peripheral side of the pump member 3 so as to be able to pivot (rock or swing), and a coil spring SP corresponding to an urging member that urges (or forces) the cam ring 4. These components are accommodated in a housing 1. In the present embodiment, the variable displacement oil pump VP1 is fixed to an engine (not shown), more specifically, a side portion of a cylinder block (not shown), with bolts (not shown).

As shown in FIG. 1, the housing 1 has a cup-shaped first housing 11 corresponding to a pump body and a lid-shaped second housing 12 corresponding to a cover member that is connected to the first housing 11 and closes an opening of the first housing 11. Each of the first housing 11 and the second housing 12 is formed as an integral member with metal material, e.g. aluminium alloy.

Figure 5:
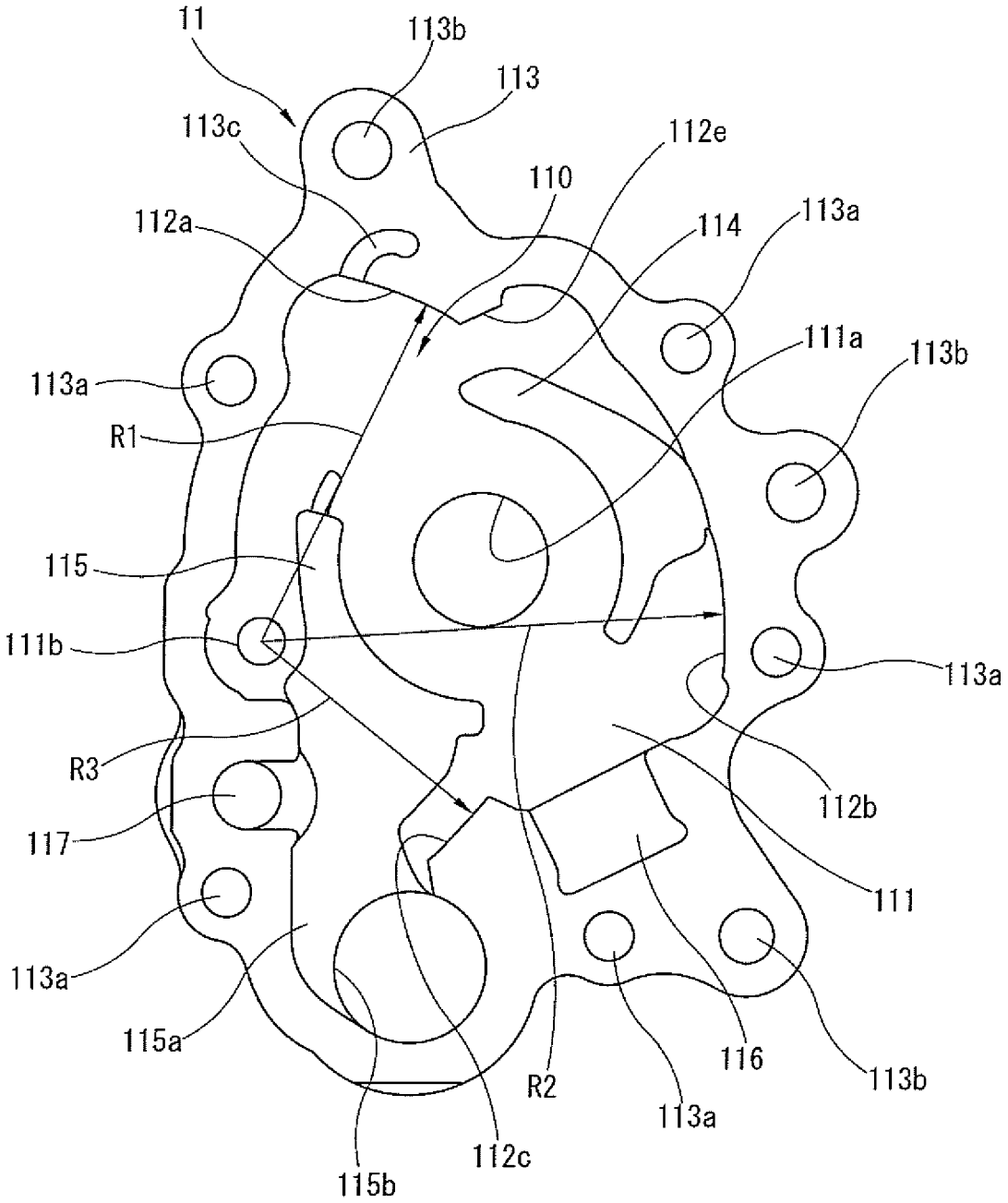
FIG. 5 is a drawing of a first housing shown in FIG. 1, viewed from its mating surface side with the second housing.

As particularly illustrated in FIGS. 1 and 5, the first housing 11 has a bottom wall 111 and a peripheral wall 112 that rises from an outer peripheral edge of the bottom wall 111 and continues in a circumferential direction along the outer peripheral edge of the bottom wall 111. That is, one end side in an axial direction of the first housing 11, which faces the second housing 12, is open, and the other end side of the first housing 11 is closed by the bottom wall 111. In other words, a cup-shaped pump accommodating portion 110 is defined at an inside of the first housing 11 by the bottom wall 111 and the peripheral wall 112.

Further, as illustrated in FIGS. 1 to 5, a brim-shaped flange portion 113 for joining with the second housing 12 is provided at an opening edge portion on the one end side in the axial direction of the first housing 11. The flange portion 113 is provided so as to extend outwards in a radial direction of the first housing 11. The flange portion 113 is formed integrally with the peripheral wall 112. The flange portion 113 has a plurality of female screw holes 113*a*. These female screw holes 113*a* are provided at some intervals in the circumferential direction. A plurality of screws SW for connecting the second housing 12 to the first housing 11 are screwed into the respective female screw holes 113*a*. The flange portion 113 also has a plurality of first housing side fixing holes 113*b*. These first housing side fixing holes 113*b* are provided at some intervals in the circumferential direction. The first housing side fixing holes 113*b* form (constitute), together with second housing side fixing holes 121*b* provided at the second housing 12, pump fixing holes for fixing the variable displacement oil pump VP1 to the cylinder block (not shown).

Further, a first bearing hole 111*a* that rotatably supports one end portion of the drive shaft 2 penetrates the bottom wall 111 at a substantially middle position of the bottom wall 111 forming (constituting) one end wall of the pump accommodating portion 110. In addition, a first pin supporting groove 111*b* that supports the cam ring 4 so as to be able to pivot (rock or swing) through a cylindrical pivot pin (or a cylindrical columnar pivot pin) 40 is formed on an inner surface of the bottom wall 111.

As shown in FIG. 5, a first seal sliding-contact surface 112*a* with which a first seal member S1 provided at an outer circumferential side of the cam ring 4 comes into sliding-contact is formed on an inner surface of the peripheral wall 112 at an upper side of FIG. 5 with respect to a line M (hereinafter, referred to as a "cam ring reference line") connecting a center of the first bearing hole 111*a* and a center of the first pin supporting groove 111*b*. The first seal sliding-contact surface 112*a* is formed into an arc surface shape having a curvature formed by a first radius R1 from the center of the first pin supporting groove 111*b*. Here, the first seal sliding-contact surface 112*a* is set to a length in a circumferential direction which allows the first seal member S1 to constantly come into sliding-contact within a pivoting range (a rocking range or a swinging range) of the cam ring 4.

Likewise, a second seal sliding-contact surface 112*b* and a third seal sliding-contact surface 112*c* with which a second seal member S2 and a third seal member S3 provided at the outer circumferential side of the cam ring 4 come into sliding-contact respectively are formed at a lower side of FIG. 5 with respect to the line M. The second seal sliding-contact surface 112*b* is formed into an arc surface shape having a curvature formed by a second radius R2 from the center of the first pin supporting groove 111*b*. The third seal sliding-contact surface 112*c* is formed into an arc surface shape having a curvature formed by a third radius R3 from the center of the first pin supporting groove 111*b*. Here, the second seal sliding-contact surface 112*b* is set to a length in the circumferential direction which allows the second seal member S2 to constantly come into sliding-contact within the pivoting range (the rocking range or the swinging range) of the cam ring 4. The third seal sliding-contact surface 112*c* is set to a length in the circumferential direction which allows the third seal member S3 to constantly come into sliding-contact within the pivoting range (the rocking range or the swinging range) of the cam ring 4.

As particularly illustrated in FIGS. 4 and 5, a substantially arc-shaped first suction port 114 is formed on the inner surface of the bottom wall 111 at an outer circumferential side of the first bearing hole 111*a* so as to be open to a region (hereinafter, referred to as a "suction region") where volumes of after-described plurality of pump chambers 30 are increased by or according to pumping action of the pump member 3. On the other hand, at an opposite side to the suction region with respect to a rotation center Z of the drive shaft 2, a substantially arc-shaped first discharge port 115 is formed so as to be open to a region (hereinafter, referred to as a "discharge region") where volumes of the after-described plurality of pump chambers 30 are decreased.

As depicted in FIG. 5, the first suction port 114 is formed so as to be narrowest at a starting end side of the first suction port 114, widest at a middle portion of the first suction port 114, and gradually narrower from the middle portion toward a terminal end portion of the first suction port 114 in a rotation direction D of the drive shaft 2. Then, oil stored in an oil pan OP of the engine is introduced into the first suction port 114 through an after-described inlet 124*a* provided at the second housing 12. In this manner, as illustrated in FIG. 4, in the variable displacement oil pump VP1, the oil stored in the oil pan OP of the engine is sucked into each pump chamber 30 located in the suction region by a negative pressure generated by or according to the pumping action of the pump member 3 through the inlet 124*a*, the first suction port 114 and an after-described second suction port 124. The first suction port 114, the second suction port 124 and the inlet 124*a* form a suction portion according to the present invention.

As depicted in FIG. 5, the first discharge port 115 is formed so as to be gradually wider from a starting end side toward a terminal end side of the first discharge port 115 in the rotation direction D of the drive shaft 2. Further, a discharge port extension portion 115*a* that extends outwards in the radial direction continues at the terminal end side of the first discharge port 115. Furthermore, an outlet 115*b* that penetrates the bottom wall 111 and is open to the outside is provided at a top end side portion of the discharge port extension portion 115*a*. In this manner, as illustrated in FIG. 4, in the variable displacement oil pump VP1, oil pressurized by the pumping action of the pump member 3 and discharged to the first discharge port 115 and an after-described second discharge port 125 is supplied to each sliding part (e.g. a crank metal CM) (not shown) of the engine (not shown), an oil jet device OJ (not shown) for cooling a piston (not shown) of the engine (not shown), a valve timing control device VT (not shown) etc. from the outlet 115*b* through a main gallery MG provided at an inside of the cylinder block (not shown). The first discharge port 115, the second discharge port 125 and the outlet 115*b* form a discharge portion according to the present invention.

As illustrated in FIGS. 1 to 3 and 6, the second housing 12 functions as the cover member closing the one end side opening of the first housing 11, and is connected to the flange portion 113 of the first housing 11 with the plurality of screws SW. More specifically, the second housing 12 has a plurality of screw penetration holes 121*a* provided at positions corresponding to the respective female screw holes 113*a* of the first housing 11. By screwing the plurality of screws SW penetrating the plurality of screw penetration holes 121*a* into the respective female screw holes 113*a* of the first housing 11, the second housing 12 is connected to the first housing 11.

Figure 6:
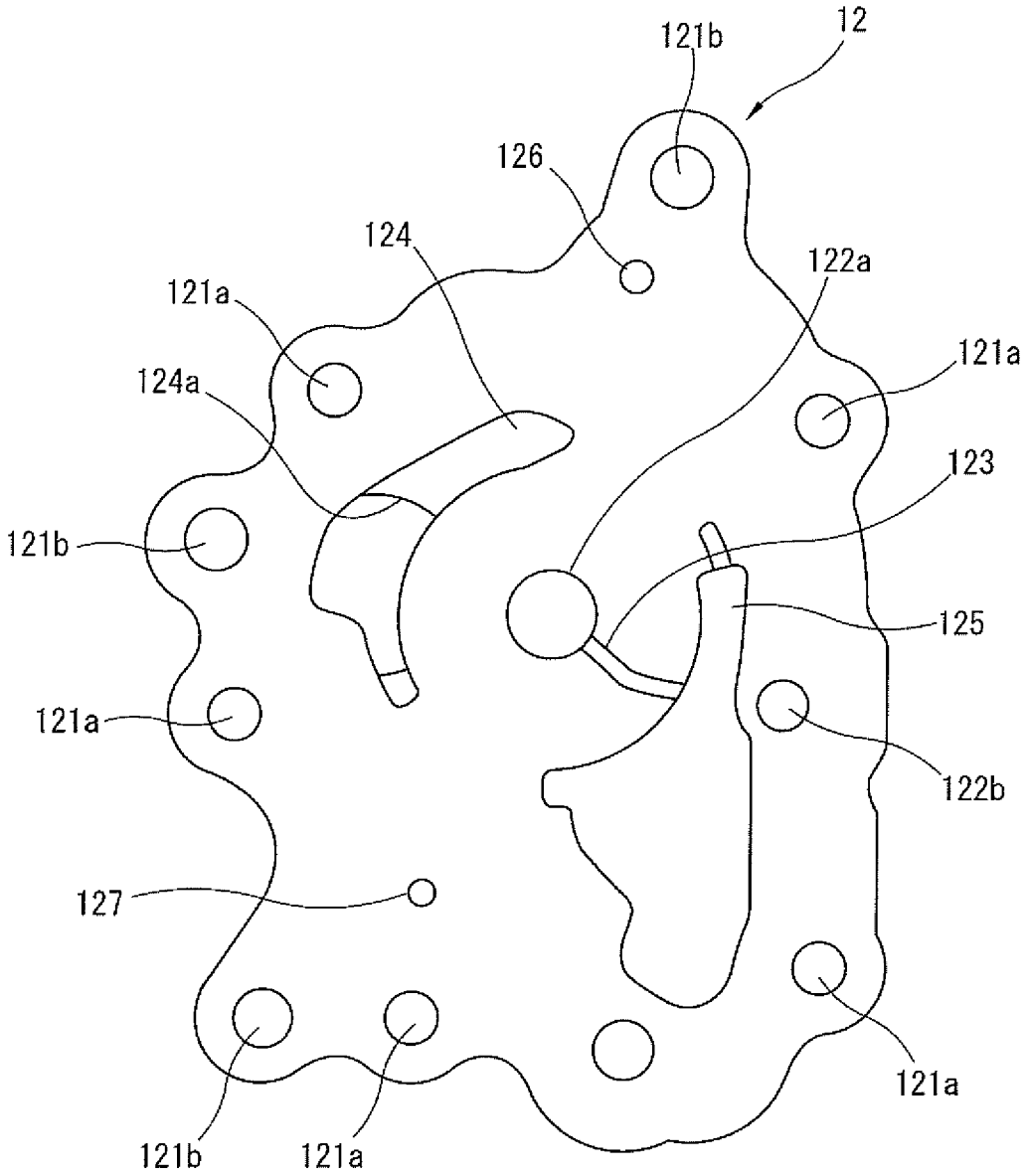
FIG. 6 is a drawing of the second housing shown in FIG. 1, viewed from its mating surface side with the first housing.

Further, as shown in FIG. 6, a second bearing hole 122*a* that rotatably supports the other end portion of the drive shaft 2 penetrates the second housing 12 at a position facing the first bearing hole 111*a* of the first housing 11. Also on an inner surface of the second housing 12, a second pin supporting groove 122*b*, the second suction port 124 and the second discharge port 125 corresponding to the first pin supporting groove 111*b*, the first suction port 114 and the first discharge port 115 of the first housing 11 respectively are formed so as to face the first pin supporting groove 111*b*, the first suction port 114 and the first discharge port 115 respectively. Furthermore, the inlet 124*a* that penetrates a bottom of the second suction port 124 and is open to the outside is provided at a starting end side of the second suction port 124. The inlet 124*a* could be directly open to the oil pan OP through an oil strainer (not shown), or might be connected to the oil pan OP through a suction passage (not shown).

In addition, a communication groove 123 connecting the second discharge port 125 and the second bearing hole 122*a* is provided on the inner surface of the second housing 12. That is, oil is supplied to the second bearing hole 122*a* through this communication groove 123, and also oil is supplied to an after-described rotor 31 and side portions of after-described vanes 32, which ensures good lubrication of each sliding-contact portion. Here, this communication groove 123 is formed so as not to coincide with a direction in which each vane 32 extends (protrudes) and retracts, thereby suppressing falling-off of each vane 32 into the communication groove 123.

Figure 4:
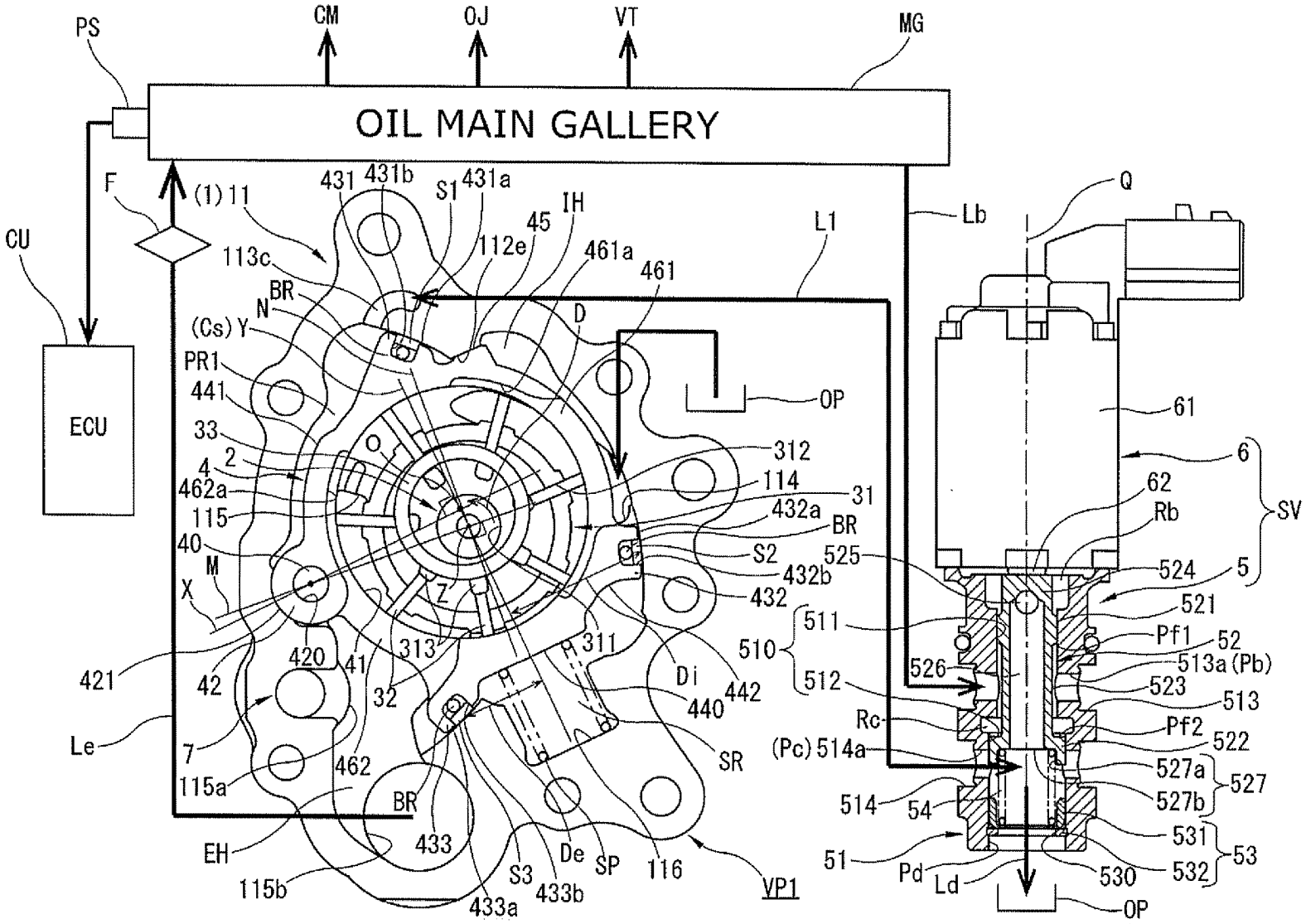
FIG. 4 is a plan view of the variable displacement oil pump shown in FIG. 3 with a second housing removed.

As for the drive shaft 2, as illustrated in FIGS. 1 to 4, a drive shaft large diameter portion 21 formed at the one end side in the axial direction of the drive shaft 2 and having a relatively large diameter is rotatably supported by the first bearing hole 111*a* of the first housing 11, while a drive shaft normal portion 22 formed at the other end side in the axial direction of the drive shaft 2 and having an outside diameter that is smaller than that of the drive shaft large diameter portion 21 is rotatably supported by the second bearing hole 122*a* of the second housing 12. A drive shaft end portion 23 formed at the one end side with respect to the drive shaft large diameter portion 21 and having a relatively small diameter faces the outside through the first bearing hole 111*a*, and is linked to a crankshaft (not shown) of the engine (not shown) through a transmission member (not shown) such as a chain (not shown). That is, the drive shaft 2 rotates the pump member 3 in the rotation direction D of FIG. 4 by a rotational force transmitted from the crankshaft (not shown). It is noted that a line N (hereinafter, referred to as a "cam ring eccentric direction line") passing through the rotation center Z of the drive shaft 2 and being orthogonal to the cam ring reference line M, shown in FIG. 4, is a boundary line between the suction region and the discharge region.

As depicted in FIGS. 1 and 4, the pump member 3 is accommodated at an inner circumferential side of the cam ring 4, and has the rotor 31 driven and rotated by the drive shaft 2 and the plurality of vanes 32 accommodated in a plurality of slits 312, which are formed by being radially cut out at an outer circumferential side of the rotor 31, so as to be able to extend (protrude) from and retract into the slits 312. In addition, a pair of ring members 33, 33 having a smaller diameter than that of the rotor 31 and accommodated at radially inner sides of the vanes 32 are arranged at both end portions in the axial direction of the rotor 31.

As shown in FIGS. 1 and 4, the rotor 31 has a shaft penetration hole 311 that penetrates a center portion of the rotor 31 along the axial direction and the plurality of slits 312 formed by being radially cut out from the center side of this shaft penetration hole 311 toward a radially outer side. Each of the slits 312 has, at a bottom thereof, a back pressure chamber 313 which is substantially circular in cross section and into which oil is introduced. That is, by a centrifugal force generated by or according to rotation of the rotor 31 and a pressure of the oil introduced into the back pressure chamber 313, each vane 32 is pushed out toward the outer side (toward the cam ring 4).

Each of the plurality of vanes 32 accommodated in the rotor 31 is formed into a rectangular plate shape with certain metal material. A top end surface of each vane 32 comes into sliding-contact with an inner circumferential surface of the cam ring 4 by or according to the rotation of the rotor 31. That is, by the sliding-contact of the top end surface of each vane 32 with the inner circumferential surface of the cam ring 4, the plurality of pump chambers 30 are defined in the rotation direction D of the rotor 31 by the rotor 31, the circumferentially adjacent pair of vanes 32, 32 and the cam ring 4. A base end surface of each vane 32 comes into sliding-contact with outer circumferential surfaces of the pair of ring members 33, 33 by or according to the rotation of the rotor 31, then is pushed up to the radially outer side of the rotor 31 by the pair of ring members 33, 33. With this configuration, even when an engine rotation speed is low and the centrifugal force by the rotation of the rotor 31 and the oil pressure in the back pressure chamber 313 are small, by the sliding-contact of the top end surface of each vane 32 with the inner circumferential surface of the cam ring 4, each pump chamber 30 is liquid-tightly partitioned off.

The cam ring 4 is formed into a substantially annular shape with sintered material. The cam ring 4 has, at the inner circumferential side thereof, a circular pump member accommodating portion 41 that can accommodate the pump member 3. The cam ring 4 also has, at the outer circumferential side thereof, a cylindrical pivot supporting portion 42 that extends along the axial direction. A pin penetration hole 420 penetrating the pivot supporting portion 42 in the axial direction is formed at the pivot supporting portion 42. That is, the cam ring 4 is supported so as to be able to pivot (rock or swing) inside the pump accommodating portion 110 through the cylindrical columnar pivot pin 40 that penetrates the pin penetration hole 420 and is supported by the first pin supporting groove 111*b* and the second pin supporting groove 122*b*. In the present embodiment, the pivot supporting portion 42 has a cylindrical shape (a tubular shape), and surrounds an outer circumference of the pivot pin 40 throughout its entire circumference. Further, the pivot supporting portion 42 is pressed against or toward the peripheral wall 112 of the pump accommodating portion 110 by a discharge pressure P that acts on an inner surface of the cam ring 4 (the pump member accommodating portion 41) in the discharge region. That is, a supporting portion top end surface 421 provided at an opposite side to the pump member accommodating portion 41 with respect to the pivot pin 40 pivots with respect to the peripheral wall 112 of the pump accommodating portion 110 when the cam ring 4 pivots (rocks or swings).

The cam ring 4 has, at the outer circumferential side thereof, a first seal forming portion 431, a second seal forming portion 432 and a third seal forming portion 433 facing the first seal sliding-contact surface 112*a*, the second seal sliding-contact surface 112*b* and the third seal sliding-contact surface 112*c* of the first housing 11 respectively. The first seal forming portion 431 has an arc-shaped first seal surface 431*a* that is concentric with the first seal sliding-contact surface 112*a*. The second seal forming portion 432 has an arc-shaped second seal surface 432*a* that is concentric with the second seal sliding-contact surface 112*b*. The third seal forming portion 433 has an arc-shaped third seal surface 433*a* that is concentric with the third seal sliding-contact surface 112*c*.

Further, a first seal holding groove 431*b* extending along the axial direction is formed on the first seal surface 431*a* so as to be open to the first seal sliding-contact surface 112*a* side. A second seal holding groove 432*b* extending along the axial direction is formed on the second seal surface 432*a* so as to be open to the second seal sliding-contact surface 112*b* side. A third seal holding groove 433*b* extending along the axial direction is formed on the third seal surface 433*a* so as to be open to the third seal sliding-contact surface 112*c* side.

The first seal member S1 coming into sliding-contact with the first seal sliding-contact surface 112*a* when the cam ring 4 pivots (rocks or swings) is accommodated in the first seal holding groove 431*b*. The second seal member S2 coming into sliding-contact with the second seal sliding-contact surface 112*b* when the cam ring 4 pivots (rocks or swings) is accommodated in the second seal holding groove 432*b*. The third seal member S3 coming into sliding-contact with the third seal sliding-contact surface 112*c* when the cam ring 4 pivots (rocks or swings) is accommodated in the third seal holding groove 433*b*.

As illustrated in FIG. 4, the first seal surface 431*a* is formed so as to have a predetermined radius that is slightly smaller than the first radius R1 forming the first seal sliding-contact surface 112*a*, and a minute clearance is formed between the first seal surface 431*a* and the first seal sliding-contact surface 112*a*. The second seal surface 432*a* is formed so as to have a predetermined radius that is slightly smaller than the second radius R2 forming the second seal sliding-contact surface 112*b*, and a minute clearance is formed between the second seal surface 432*a* and the second seal sliding-contact surface 112*b*. The third seal surface 433*a* is formed so as to have a predetermined radius that is slightly smaller than the third radius R3 forming the third seal sliding-contact surface 112*c*, and a minute clearance is formed between the third seal surface 433*a* and the third seal sliding-contact surface 112*c*.

As shown in FIGS. 1 and 4, the first seal member S1, the second seal member S2 and the third seal member S3 are each formed into a linearly long narrow shape along the axial direction of the cam ring 4 with, e.g. fluororesin material having low friction characteristics. Further, as depicted in FIG. 4, elastic members BR made of rubber are arranged at bottoms of the first seal holding groove 431*b*, the second seal holding groove 432*b* and the third seal holding groove 433*b*. That is, the first, second and third seal members S1, S2 and S3 elastically contact the first, second and third seal sliding-contact surfaces 112*a*, 112*b* and 112*c* respectively by elastic forces of the elastic members BR, and thus the clearances between the first, second and third seal surfaces 431*a*, 432*a* and 433*a* and the first, second and third seal sliding-contact surfaces 112*a*, 112*b* and 112*c* respectively are liquid-tightly sealed.

With this configuration or structure, as depicted in FIG. 4, a first control hydraulic chamber PR1 is defined at the outer circumferential side of the cam ring 4 by the pivot supporting portion 42 supported through the pivot pin 40 and the first seal member S1. A first control oil pressure P1 depressurized from a discharge pressure introduction passage Lb branched off from the main gallery MG through an after-described control valve SV is led to the first control hydraulic chamber PR1 through a first passage L1. The first passage L1 is connected to a first control pressure introduction hole 126 that penetrates the second housing 12, and the first control oil pressure P1 is introduced into the first control hydraulic chamber PR1 from the first control pressure introduction hole 126 through a first control pressure introduction groove 113*c* provided at the flange portion 113 of the first housing 11. The oil pressure introduced into the first control hydraulic chamber PR1 acts on a first pressure receiving surface 441 that is an outer circumferential surface, facing the first control hydraulic chamber PR1, of the cam ring 4 and that is located in a first region formed between the pivot supporting portion 42 and the first seal forming portion (the first seal member S1). By this oil pressure acting on the first pressure receiving surface 441, a moving force (a pivoting force, a rocking force or a swinging force) is given to the cam ring 4 in a direction (hereinafter, referred to as a "concentric direction") in which an eccentric amount Δ of the cam ring 4 (an eccentric amount of a center O of the pump member accommodating portion 41 with respect to the rotation center Z of the drive shaft 2) is decreased.

Further, a suction side chamber IH is defined at the outer circumferential side of the cam ring 4 by the first seal member S1 and the second seal member S2. Oil stored in the oil pan OP is led to the suction side chamber IH by a negative pressure generated by or according to the pumping action of the pump member 3. The oil led to the suction side chamber IH is led to the pump chambers 30 located in the suction region through the first and second suction ports 114, 124 and after-described suction side cut-out grooves 461*a*.

The cam ring 4 has a suction side groove forming portion 461 where the suction side cut-out grooves 461*a* are formed by cutting out axial direction both end surfaces of the cam ring 4 which face the suction region. That is, the suction side groove forming portion 461 is formed to be thinner than a normal portion 460 of the cam ring 4, and forms communication passages through which the pump chambers 30 located in the suction region and the suction side chamber IH directly communicate with each other between the first housing 11 (the bottom wall 111) and the second housing 12.

The suction side cut-out groove 461*a* is open so as to communicate with the suction side chamber IH at a middle portion of the suction side cut-out groove 461*a* in the suction region, and an opening width at the suction side chamber IH side is set to be smaller than an opening width at the pump chamber 30 side. More specifically, the opening width at the pump chamber 30 side is formed to be greater than the opening width at the suction side chamber IH side so that both end sides in a circumferential direction of the suction side cut-out groove 461*a* expand from the outer circumferential side of the cam ring 4 toward the inner circumferential surface of the cam ring 4. It is noted that the suction side cut-out grooves 461*a* are open so as to be able to communicate with all pump chambers 30 located in the suction region except for pump chambers 30 corresponding to a pair of closing portions that do not communicate with any of the first and second suction ports 114, 124 and the first and second discharge ports 115, 125.

In addition, a spring accommodating chamber SR is defined at the outer circumferential side of the cam ring 4 by the second seal member S2 and the third seal member S3. This spring accommodating chamber SR is located at an opposite side to the first control hydraulic chamber PR1 with respect to the rotation center Z of the drive shaft 2 so as to face the first control hydraulic chamber PR1. A spring accommodating portion 116 formed by recessing the inner side of the peripheral wall 112 of the pump accommodating portion 110 is open in the spring accommodating chamber SR, and the coil spring SP is inserted between the spring accommodating portion 116 and the cam ring 4 with a predetermined pre-load (a set load W1).

The spring accommodating portion 116 is formed along a line Y (hereinafter, referred to as a "cam ring forcing direction line") that is substantially orthogonal to a line X (hereinafter, referred to as a "cam ring center line") connecting the center O of the pump member accommodating portion 41 corresponding to a center of an inner circumference of the cam ring 4 and the center of the first pin supporting groove 111*b* and that passes through the rotation center Z of the drive shaft 2. As shown in FIG. 5, the spring accommodating portion 116 is provided so as to be shifted to the first discharge port 115 side (eccentrically toward the first discharge port 115) between the first suction port 114 and the first discharge port 115. More specifically, the spring accommodating portion 116 is arranged so that a distance De between the third seal member S3 corresponding to a discharge side seal portion and a center Cs of the coil spring SP is shorter than a distance Di between the second seal member S2 corresponding to a suction side seal portion and the center Cs of the coil spring SP.

The spring accommodating portion 116 has a spring chamber communication hole 127 that penetrates the second housing 12 and is open. The spring chamber communication hole 127 is open at the center Cs of the coil spring SP and is open to the air (the atmosphere), then serves to adjust a pressure in the spring accommodating chamber SR. Here, the spring chamber communication hole is not limited to the spring chamber communication hole 127 that is open at the center Cs of the coil spring SP like the present embodiment, but could be located at a position not facing the coil spring SP.

Further, a spring contact portion 440 with which the coil spring SP can come into contact is provided at an outer side portion of the cam ring 4. This spring contact portion 440 is provided so as to face the spring accommodating portion 116. The spring contact portion 440 is formed by a flat surface that is substantially parallel to the cam ring center line X. An urging force of the coil spring SP acts on the spring contact portion 440, then a moving force (a pivoting force, a rocking force or a swinging force) is given to the cam ring 4 in a direction (hereinafter, referred to as an "eccentric direction") in which the eccentric amount Δ of the cam ring 4 is increased.

With this configuration or structure, when an urging force based on an internal pressure (the first control oil pressure P1) of the first control hydraulic chamber PR1 is smaller than the set load W1 of the coil spring SP, the cam ring 4 moves in the eccentric direction according to the set load W1 of the coil spring SP and is brought to a maximum eccentric state as shown in FIG. 4. On the other hand, when the discharge pressure P is increased and the urging force based on the internal pressure (the first control oil pressure P1) of the first control hydraulic chamber PR1 exceeds the set load W1 of the coil spring SP, the cam ring 4 moves in the concentric direction according to the discharge pressure P.

Further, at the outer circumferential side of the cam ring 4, a stopper portion 45 that comes into contact with a cam ring contact portion 112*e* provided at the peripheral wall 112 of the pump accommodating portion 110 and that restrains the movement of the cam ring 4 in the direction in which the eccentric amount Δ of the cam ring 4 is increased is provided at an opposite side to the spring contact portion 440 with respect to the center O of the pump member accommodating portion 41. The cam ring contact portion 112*e* is provided in a region corresponding to the suction side chamber IH, and located at a position that does not overlap the first suction port 114, the second suction port 124 and the inlet 124*a* that form the suction portion according to the present invention. The stopper portion 45 has a stopper contact surface 450 formed by a flat surface that is substantially parallel to the spring contact portion 440, i.e. a flat surface that is substantially perpendicular to a direction in which the urging force of the coil spring SP acts. That is, when the cam ring 4 moves in the eccentric direction, the stopper contact surface 450 of the stopper portion 45 comes into contact with the cam ring contact portion 112*e*, then a maximum eccentric amount of the cam ring 4 is limited. Here, the stopper portion 45 and the cam ring contact portion 112*e* could be provided not only in the region of the suction side chamber IH, but also in regions of an after-described discharge side chamber EH and the spring accommodating chamber SR. Also, each of the stopper portion 45 and the cam ring contact portion 112*e* could be formed by a flat surface that is not perpendicular to the direction in which the urging force of the coil spring SP acts.

The discharge side chamber EH is defined at the outer circumferential side of the cam ring 4 by the pivot pin 40 and the third seal member S3. The discharge port extension portion 115*a* faces the discharge side chamber EH. Oil discharged from the pump chambers 30 located in the discharge region is led to the discharge side chamber EH through the first and second discharge ports 115, 125 and after-described discharge side cut-out grooves 462*a*. The oil led to the discharge side chamber EH is discharged from the outlet 115*b*, passes through a filter F, and is discharged into the main gallery MG through a discharge passage Le.

The cam ring 4 has a discharge side groove forming portion 462 where the discharge side cut-out grooves 462*a* are formed by cutting out axial direction both end surfaces of the cam ring 4 which face the discharge region. That is, the discharge side groove forming portion 462 is formed to be thinner than the normal portion 460 of the cam ring 4, and forms communication passages through which the pump chambers 30 located in the discharge region and the discharge side chamber EH directly communicate with each other between the first housing 11 (the bottom wall 111) and the second housing 12.

The discharge side cut-out groove 462*a* is open so as to communicate with the discharge side chamber EH at a terminal end side of the discharge side cut-out groove 462*a* in the discharge region, and an opening width at the discharge side chamber EH side is set to be smaller than an opening width at the pump chamber 30 side. More specifically, the opening width at the pump chamber 30 side is formed to be greater than the opening width at the discharge side chamber EH side so that one end side (a starting end side in the discharge region) in a circumferential direction of the discharge side cut-out groove 462*a* expands from the outer circumferential side of the cam ring 4 toward the inner circumferential surface of the cam ring 4. It is noted that the discharge side cut-out grooves 462*a* are open so as to be able to communicate with all pump chambers 30 located in the discharge region except for pump chambers 30 corresponding to closing portions that do not communicate with any of the first and second suction ports 114, 124 and the first and second discharge ports 115, 125.

With this configuration or structure, the variable displacement oil pump VP1 has, between the first control hydraulic chamber PR1 and the spring accommodating chamber SR, a series of suction discharge passage that is liquid-tightly defined with respect to the first control hydraulic chamber PR1 and the spring accommodating chamber SR. This suction discharge passage includes the first and second suction ports 114, 124, the suction side cut-out grooves 461*a*, the pump chambers 30 facing the suction region and the discharge region, the discharge side cut-out grooves 462*a* and the first and second discharge ports 115, 125. In other words, the suction discharge passage is formed so as to penetrate between the first control hydraulic chamber PR1 and the spring accommodating chamber SR without being blocked by the first control hydraulic chamber PR1 and the spring accommodating chamber SR.

Further, a relief valve 7 provided at the first housing 11 adjacently to the discharge port extension portion 115*a* faces the discharge side chamber EH. As illustrated in FIGS. 1 and 4, the relief valve 7 has a ball valve body 71 provided slidably in a relief valve hole 117 that penetrates the bottom wall 111 of the first housing 11, a valve spring 72 constantly forcing the ball valve body 71 in a valve closing 10 direction and a substantially annular retainer member 73 on which the valve spring 72 is seated. That is, when a pump discharge pressure becomes higher than an urging force of the valve spring 72, the ball valve body 71 is pushed back by the pump discharge pressure, and the discharge side chamber EH communicates with the outside (the oil pan OP), then oil whose pressure becomes excessive is returned to the oil pan OP, which corresponds to a low pressure part, through a drain passage Ld. This suppresses malfunction in the engine (not shown) and the valve timing control device (not shown) etc. which is caused by supply of the oil having excessive pressure. Here, as long as the relief valve hole 117 communicates with the low pressure part, not only the configuration in which the relief valve hole 117 communicates with the oil pan OP which is at atmospheric pressure, but also, for instance, a configuration in which the relief valve hole 117 communicates with a portion close to the inlet 124*a* which is at a negative pressure, could be applied.

(Configuration of Control Valve)

In the variable displacement oil pump VP1, as shown in FIG. 4, introduction of oil (the first control oil pressure P1) into the first control hydraulic chamber PR1 is controlled by the control valve SV which corresponds to a control mechanism. The control valve SV is a solenoid valve driven and controlled by a control device CU that performs engine control. More specifically, the control valve SV has a valve part 5 for performing open/closure control of the first passage L1 and a solenoid part 6 provided at one end portion of the valve part 5 and performing the open/closure control of the valve part 5 according to exciting current that is output by the control device CU.

The valve part 5 is a so-called three-way valve, and has a valve case 51, a spool valve body 52, a retainer member 53 and a valve spring 54. The valve part 5 could be provided integrally with the variable displacement oil pump VP1 so as to be mounted in the housing 1, or might be provided as a separate valve independently of the variable displacement oil pump VP1.

The valve case 51 is made of predetermined metal material, for instance, aluminium alloy material, and has a substantially cylindrical shape (a substantially tubular shape) whose both end portions in a direction of a center axis Q are open. The valve case 51 has, at an inside thereof, a valve body accommodating portion 510. The valve body accommodating portion 510 is formed by a stepped penetration hole penetrating the valve case 51 along the direction of the center axis Q of the valve case 51. That is, the valve body accommodating portion 510 has a first valve body sliding-contact portion 511 at one end side in the center axis Q direction and a second valve body sliding-contact portion 512 having a larger diameter than that of the first valve body sliding-contact portion 511 at the other end side in the center axis Q direction. An opening of the valve body accommodating portion 510 at the first valve body sliding-contact portion 511 side is closed by the solenoid part 6. On the other hand, an opening of the valve body accommodating portion 510 at the second valve body sliding-contact portion 512 side functions as a drain port Pd that discharges oil of an after-described spring accommodating chamber 55, and is open to the drain passage Ld. Here, the drain port Pd could be directly open to the oil pan OP corresponding to the low pressure part, without being open to the drain passage Ld. Further, as long as the drain port Pd communicates with the low pressure part, not only the configuration in which the drain port Pd is open to the oil pan OP corresponding to atmospheric pressure, but also, for instance, a configuration in which the drain port Pd communicates with a portion close to the inlet 124*a* which is at a negative pressure, could be applied. In the following description, for the sake of convenience in description of the valve part 5, an end portion at the first valve body sliding-contact portion 511 side (an upper side in FIG. 4) is referred to as a "first end portion", and an end portion at the second valve body sliding-contact portion 512 side (a lower side in FIG. 4) is referred to as a "second end portion".

A first annular groove 513 formed by cutting out an outer circumferential surface of the valve case 51 along a circumferential direction is formed at an outer circumferential side of the first valve body sliding-contact portion 511. Further, a plurality of first valve holes 513*a* connecting an inside and an outside of the valve body accommodating portion 510 in a radial direction of the valve case 51 which is orthogonal to the center axis Q are formed at a bottom of the first annular groove 513. Each of the first valve holes 513*a* is formed by a round hole that is substantially circular in plan view, and functions as an introduction port Pb that introduces oil (the discharge pressure P) from the discharge pressure introduction passage Lb.

Likewise, a second annular groove 514 formed by cutting out the outer circumferential surface of the valve case 51 along the circumferential direction is formed at an outer circumferential side of the second valve body sliding-contact portion 512. Further, second valve holes 514*a* connecting the inside and the outside of the valve body accommodating portion 510 in the radial direction of the valve case 51 which is orthogonal to the center axis Q are formed at a bottom of the second annular groove 514. Each of the second valve holes 514*a* is formed by a round hole that is substantially circular in plan view, and functions as a supply/discharge port Pc that supplies and discharges oil (the first control oil pressure P1) to and from the first control hydraulic chamber PR1 through the first passage L1.

The spool valve body 52 has a stepped cylindrical shape (a stepped tubular shape) having different outside diameters in the center axis Q direction that is a moving direction of the spool valve body 52, and is slidably accommodated in the valve body accommodating portion 510 of the valve case 51. More specifically, the spool valve body 52 has a first land portion 521 coming into sliding-contact with the first valve body sliding-contact portion 511 and a second land portion 522 having a larger diameter than that of the first land portion 521 and coming into sliding-contact with the second valve body sliding-contact portion 512. Further, a middle shaft portion 523 having an outside diameter that is smaller than those of the first land portion 521 and the second land portion 522 is formed between the first land portion 521 and the second land portion 522. That is, the middle shaft portion 523 defines an intermediate chamber Rc between the middle shaft portion 523 and the valve body accommodating portion 510 in the radial direction of the valve case 51.

The first land portion 521 and the second land portion 522 that face each other in the center axis Q direction in the intermediate chamber Rc act as pressure receiving surfaces that receive oil pressure led from the first valve holes 513*a*. The second land portion 522 has an outside diameter that is larger than that of the first land portion 521, and a second pressure receiving surface Pf2 formed by the second land portion 522 is formed to be greater than a first pressure receiving surface Pf1 formed by the first land portion 521. That is, by a difference in pressure receiving area between these first pressure receiving surface Pf1 and second pressure receiving surface Pf2, the oil pressure introduced from the first valve holes 513*a* into the intermediate chamber Rc acts on the second pressure receiving surface Pf2 that is great relative to the first pressure receiving surface Pf1, then the spool valve body 52 is pressed to the second end portion side.

The spool valve body 52 also has, at the first end portion side with respect to the first land portion 521, a shaft end portion 524 having an outside diameter that is smaller than that of the first land portion 521. The shaft end portion 524 defines a back pressure chamber Rb between the shaft end portion 524 and the valve body accommodating portion 510 in the radial direction of the valve case 51. The back pressure chamber Rb collects oil that leaks from the intermediate chamber Rc through an outer circumferential side of the first land portion 521 (a minute clearance between the first land portion 521 and the valve body accommodating portion 510). The back pressure chamber Rb communicates with the spring accommodating chamber 55 through a discharge hole 525 formed on a circumferential wall, facing the back pressure chamber Rb, of the first end portion of the spool valve body 52 and an inside passage 526 connecting the discharge hole 525 and the after-described spring accommodating chamber 55. That is, the oil collected in the back pressure chamber Rb is led to the spring accommodating chamber 55 through the discharge hole 525 and the inside passage 526, and discharged to the oil pan OP through the drain port Pd and the drain passage Ld.

The spool valve body 52 further has, at an end portion thereof on the second land portion 522 side which faces the retainer member 53, a spring supporting portion 527 that supports a first end portion, facing the spool valve body 52, of the valve spring 54. The spring supporting portion 527 is formed by expanding an inner circumferential side of the spool valve body 52 stepwise toward the second land portion 522 side. The spring supporting portion 527 has a tubular spring surrounding portion 527*a* and a flat spring supporting surface 527*b*. With this structure, the spring supporting portion 527 supports the first end portion of the valve spring 54 by the spring supporting surface 527*b* while surrounding an outer circumferential side of the first end portion of the valve spring 54 by the spring surrounding portion 527*a*.

The retainer member 53 has a tubular portion 531 and a bottom wall portion 532 closing an outer end portion of the tubular portion 531, and is formed into a substantially closed-bottomed tubular shape. The retainer member 53 is fitted into an opening end portion at the second end portion side of the valve case 51 so that an opening of the tubular portion 531 faces the spring supporting portion 527 of the spool valve body 52. With this structure, the retainer member 53 supports a second end portion of the valve spring 54 by an inner end surface of the bottom wall portion 532 while surrounding an outer circumferential side of the second end portion of the valve spring 54 by the tubular portion 531. The retainer member 53 also has a round retainer opening 530 at a middle position of the bottom wall portion 532. That is, the retainer opening 530 penetrates the bottom wall portion 532, and connects the second valve holes 514*a* and the drain port Pd.

The valve spring 54 is a well-known compression coil spring. The valve spring 54 is inserted in the spring accommodating chamber 55 defined between the spool valve body 52 and the retainer member 53 with a predetermined preload (a set load W2). With this, the valve spring 54 constantly forces the spool valve body 52 to the first end portion side according to the set load W2.

The solenoid part 6 has a cylindrical casing (a tubular casing) 61, a coil (not shown) and an armature (not shown) both accommodated in the casing 61 and a rod 62 fixed to the armature and provided movably forward and backward along the center axis Q direction together with the armature. It is noted that the exciting current flows in the solenoid part 6 from the control device CU on the basis of an engine operating state detected or calculated by predetermined parameters such as oil temperature and water temperature of the engine and an engine rotation speed. Then, the solenoid part 6 can continuously change a magnitude of an electromagnetic force Fm according to a supplied current value. The solenoid part 6 is controlled by pulse width modulation (PWM), and its current value is given by a duty ratio Dt.

(Description of Operation of Oil Pump)

Next, operation of the variable displacement oil pump VP1 according to the present embodiment will be described with reference to FIG. 4.

That is, rotation of the crankshaft (not shown) is transmitted to the drive shaft 2 through the chain (not shown), then in the variable displacement oil pump VP1 according to the present embodiment, the rotor 31 is driven and rotated in the rotation direction D through the drive shaft 2. Oil is then sucked up from the oil pan OP through the inlet 124*a*, the first and second suction ports 114, 124 and the pair of suction side cut-out grooves 461*a* according to rotation of the rotor 31. At the same time as this suction operation (suction action), oil is discharged to the discharge passage Le through the pair of discharge side cut-out grooves 462*a*, the first and second discharge ports 115, 125, the discharge port extension portion 115*a* and the outlet 115*b*. The oil discharged to the discharge passage Le is pressure-fed to each sliding part (the crank metal CM) (not shown) of the engine (not shown), the oil jet device OJ (not shown), the valve timing control device VT (not shown) etc. through the main gallery MG, and also led to the introduction port Pb of the control valve SV through the discharge pressure introduction passage Lb. Here, an oil pressure sensor PS that can detect the discharge pressure P is arranged at the main gallery MG, and a detection result of this pressure sensor PS is fed back to the control device CU.

Further, by the pivotal movement of the cam ring 4 on the pivot pin 40, the eccentric amount Δ, which is a difference between the rotation center Z of the drive shaft 2 and the center O of the pump member accommodating portion 41, changes, then a volume variation (a difference between a maximum volume and a minimum volume) of each pump chamber 30 changes. When the eccentric amount Δ increases, the volume variation of the pump chamber 30 also increases, whereas when the eccentric amount Δ decreases, the volume variation of the pump chamber 30 also decreases. The eccentric amount Δ changes according to the urging force in the concentric direction based on the internal pressure (the first control oil pressure P1) of the first control hydraulic chamber PR1 and the urging force in the eccentric direction based on the set load W1 of the coil spring SP. That is, when the urging force in the concentric direction based on the internal pressure (the first control oil pressure P1) of the first control hydraulic chamber PR1 is smaller than the urging force in the eccentric direction based on the set load W1 of the coil spring SP, the cam ring 4 pivots in the eccentric direction, and the eccentric amount Δ increases. On the other hand, when the urging force in the concentric direction based on the internal pressure (the first control oil pressure P1) of the first control hydraulic chamber PR1 is greater than the urging force in the eccentric direction based on the set load W1 of the coil spring SP, the cam ring 4 pivots in the concentric direction, and the eccentric amount Δ decreases. Then, the cam ring 4 stops at a position where the urging force in the concentric direction based on the internal pressure (the first control oil pressure P1) of the first control hydraulic chamber PR1 and the urging force in the eccentric direction based on the set load W1 of the coil spring SP are balanced.

(Description of Operation of Control Valve)

Figure 7:
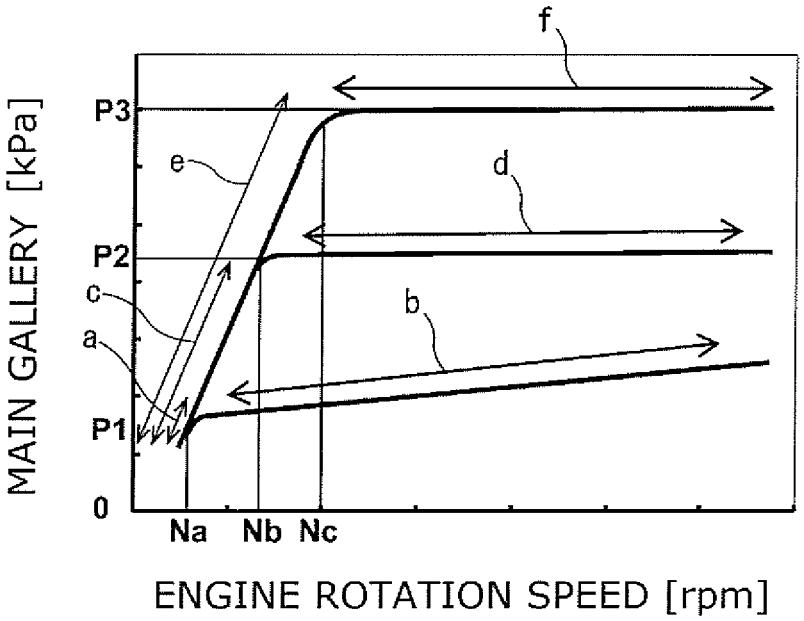
FIG. 7 is a graph showing discharge hydraulic pressure characteristics of the variable displacement oil pump according to the present invention.
Figure 8A:
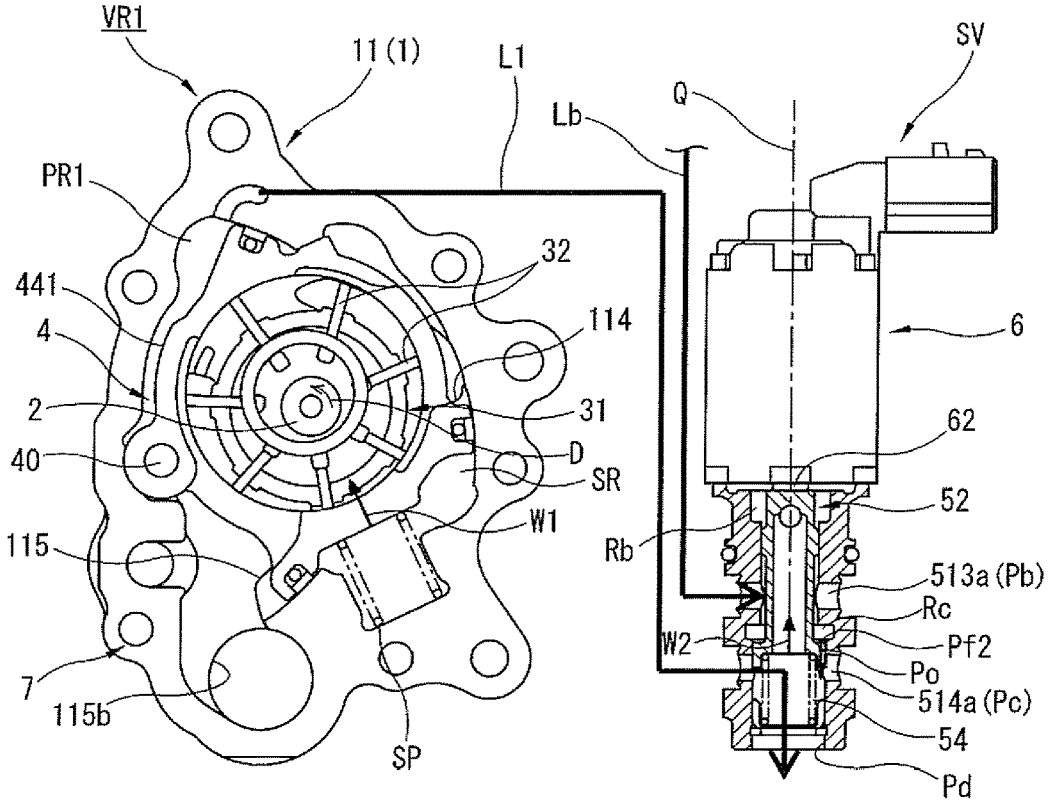
FIGS. 8A and 8B are hydraulic circuit diagrams showing respective operating states of the variable displacement oil pump according to the first embodiment of the present invention.
Figure 8B:
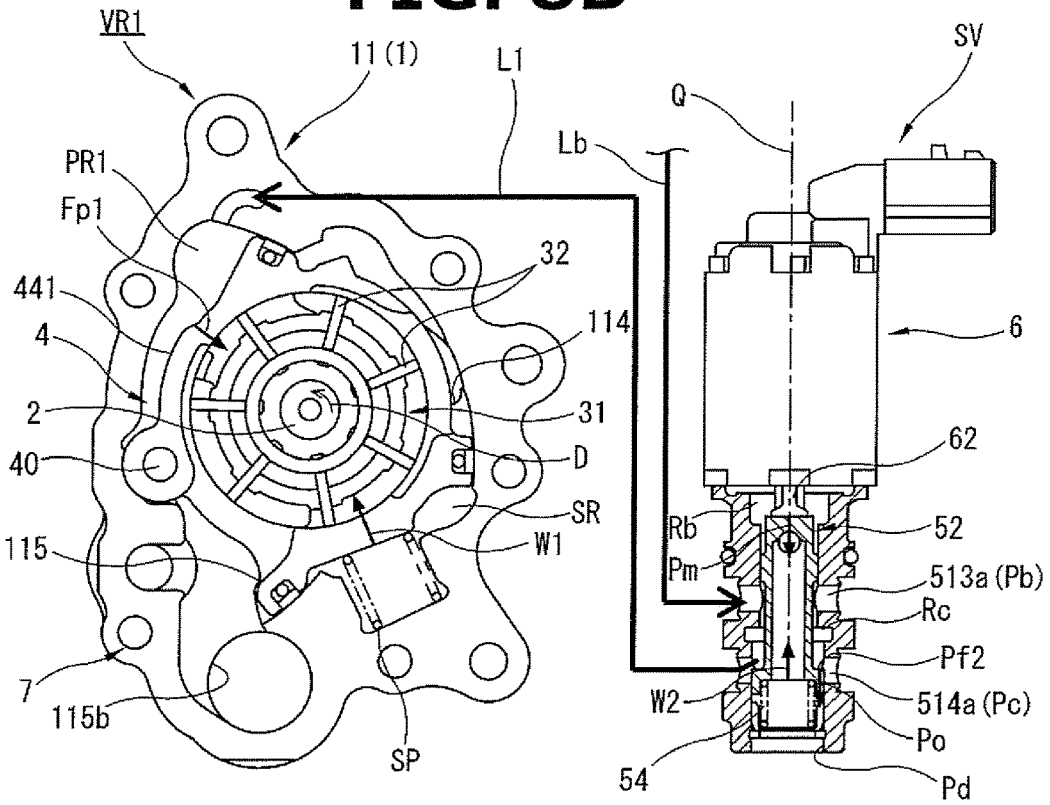
Figure 9A:
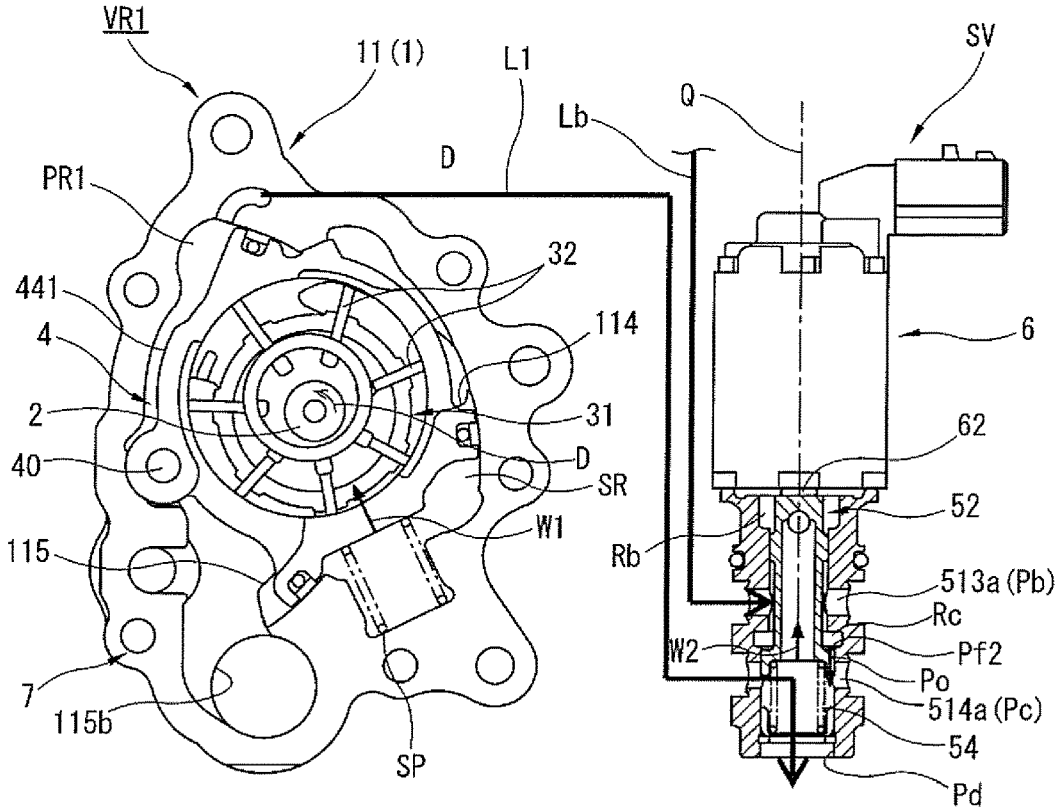
FIGS. 9A and 9B are hydraulic circuit diagrams showing respective operating states of the variable displacement oil pump according to the first embodiment of the present invention.
Figure 9B:
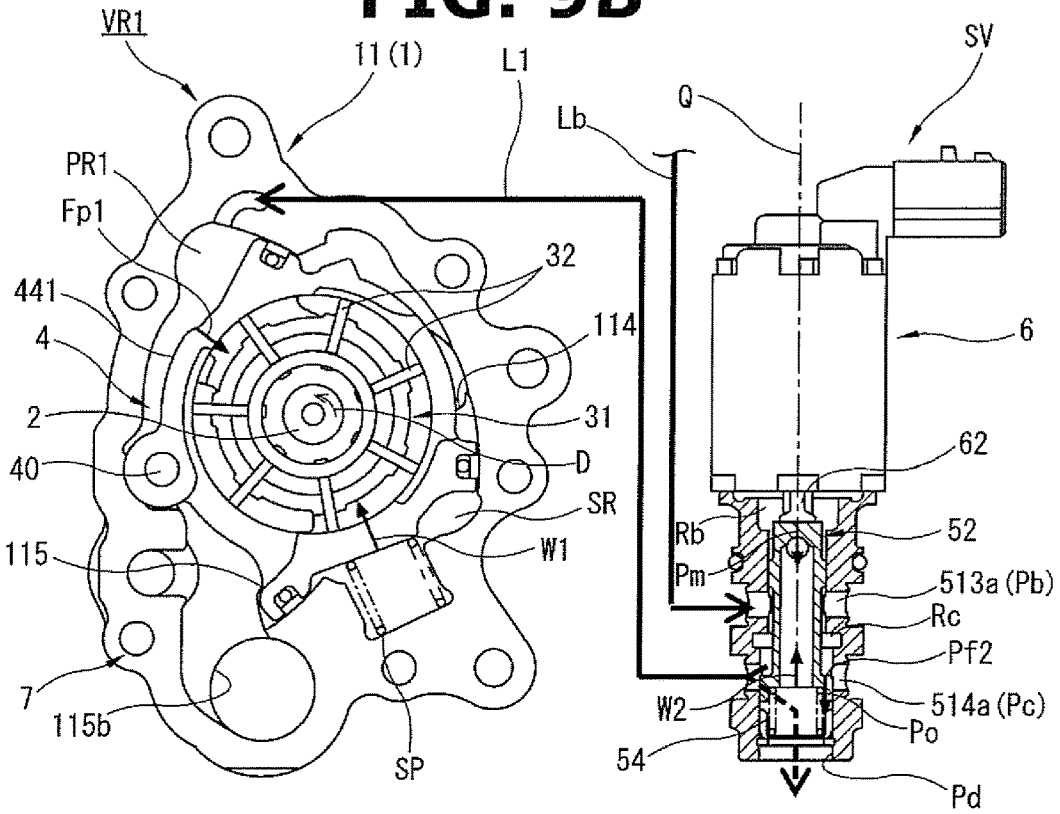
Figure 10A:
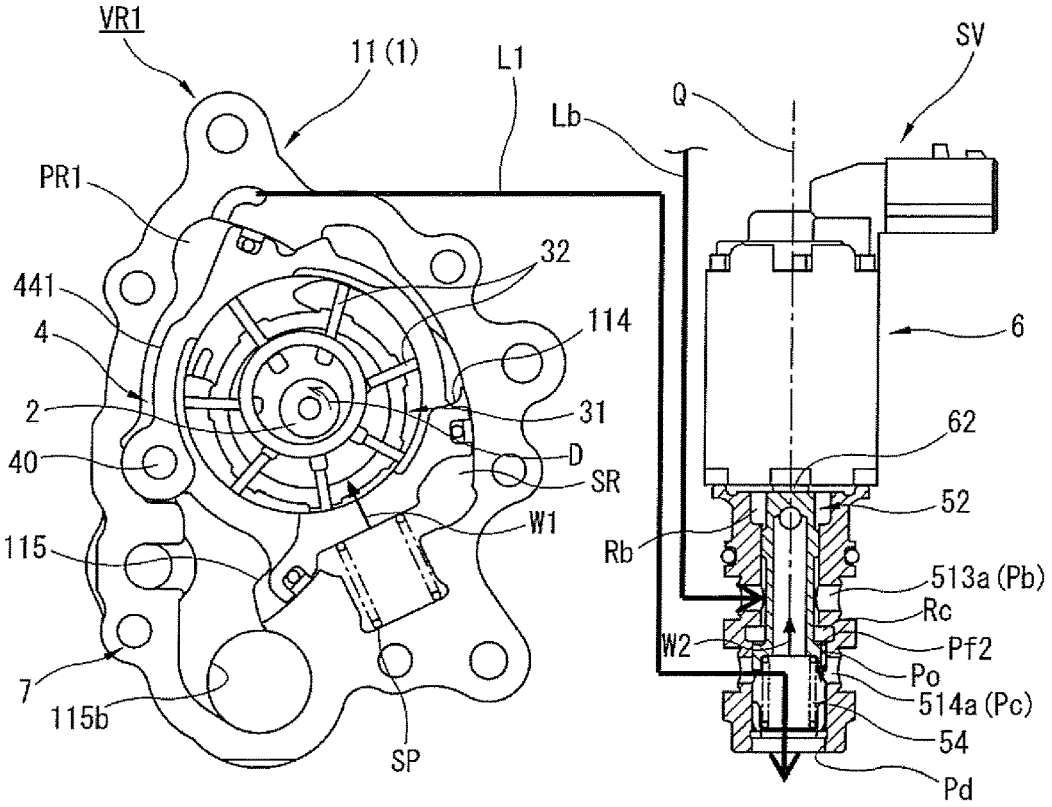
FIGS. 10A and 10B are hydraulic circuit diagrams showing respective operating states of the variable displacement oil pump according to the first embodiment of the present invention.
Figure 10B:
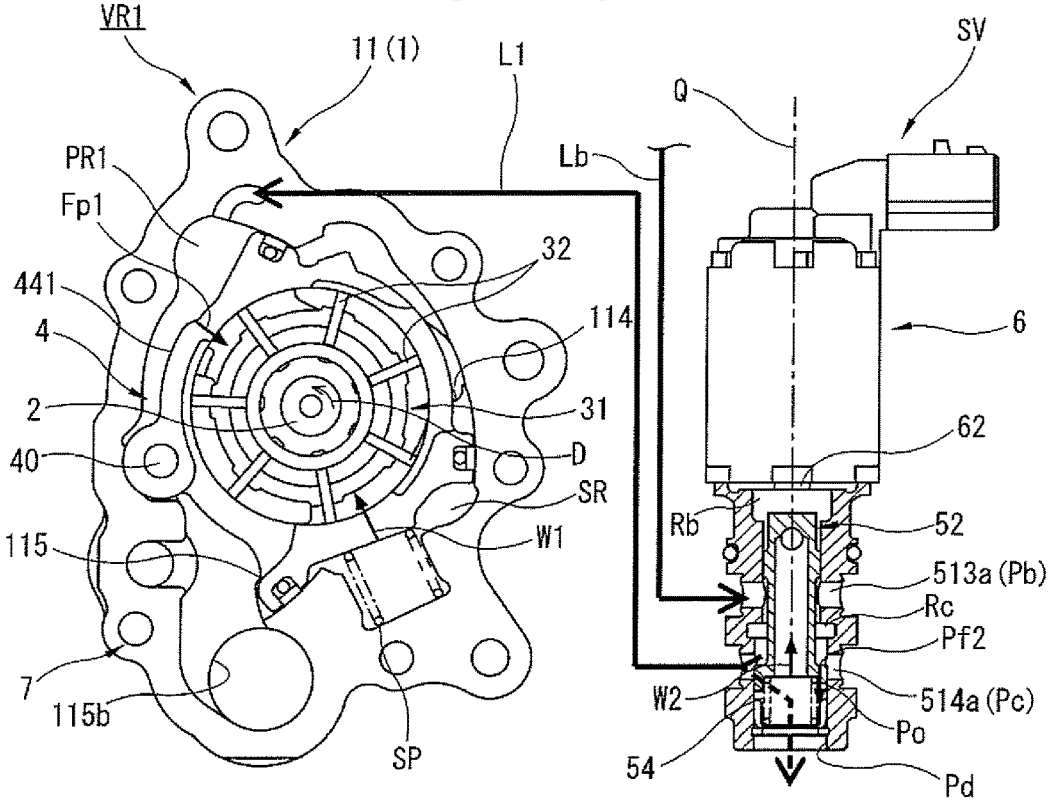

FIG. 7 is a graph showing discharge hydraulic pressure characteristics of the variable displacement oil pump VP1. FIGS. 8A and 8B are hydraulic circuit diagrams showing respective operating states of the variable displacement oil pump VP1. FIG. 8A shows a pump state of a section a in FIG. 7. FIG. 8B shows a pump state of a section b in FIG. 7. FIGS. 9A and 9B are hydraulic circuit diagrams showing respective operating states of the variable displacement oil pump VP1. FIG. 9A shows a pump state of a section c in FIG. 7. FIG. 9B shows a pump state of a section d in FIG. 7. FIGS. 10A and 10B are hydraulic circuit diagrams showing respective operating states of the variable displacement oil pump VP1. FIG. 10A shows a pump state of a section e in FIG. 7. FIG. 10B shows a pump state of a section f in FIG. 7.

P1 in FIG. 7 indicates a first engine required oil pressure, which corresponds to, for instance, a required oil pressure of the valve timing control device VT. P2 in FIG. 7 indicates a second engine required oil pressure, which corresponds to, for instance, a required oil pressure of the oil jet device OJ for cooling a piston of the engine. P3 in FIG. 7 indicates a third engine required oil pressure, which corresponds to, for instance, a required oil pressure required for lubrication of a bearing portion (the crank metal CM) of the crankshaft when the engine rotation speed is high.

That is, in the variable displacement oil pump VP1, in the section a from an engine start to a rotation speed Na, an urging force Po generated by the discharge pressure P acting on the second pressure receiving surface Pf2 of the spool valve body 52 is smaller than the set load W2 of the valve spring 54. Therefore, as shown in FIG. 8A, the spool valve body 52 is maintained at a position on the first end portion side which is an initial position, and the supply/discharge port Pc communicates with the drain port Pd (a first state). As a result, the discharge pressure P (the first control oil pressure P1) is not introduced into the first control hydraulic chamber PR1, and the cam ring 4 is maintained as it is in the maximum eccentric state according to the set load W1 of the coil spring SP.

At a time when the discharge pressure P reaches the first engine required oil pressure P1, when maintaining the discharge pressure P at this first engine required oil pressure P1, the duty ratio Dt of the exciting current supplied to the solenoid part 6 is set to 100%. With this, an electromagnetic force Pm generated at the solenoid part 6, i.e. a pressing force with which the rod 62 presses the spool valve body 52, becomes greater than the set load W2 of the valve spring 54. Then, as shown in FIG. 8B, the spool valve body 52 moves to the second end portion side, communication between the supply/discharge port Pc and the drain port Pd is interrupted, and the introduction port Pb and the supply/discharge port Pc communicate with each other (a second state). As a result, in the section b in FIG. 7, the discharge pressure P (the first control oil pressure P1) is introduced into the first control hydraulic chamber PR1, and the eccentric amount Δ of the cam ring 4 decreases according to increase of the discharge pressure P (the first control oil pressure P1) introduced into the first control hydraulic chamber PR1, then the discharge pressure P gently increases.

In the variable displacement oil pump VP1, in the section c or the section e in FIG. 7 in which the engine rotation speed N is greater than the rotation speed Na and smaller than a rotation speed Nc, as shown in FIGS. 9A and 10A, the urging force Po generated by the discharge pressure P acting on the second pressure receiving surface Pf2 of the spool valve body 52 is smaller than the set load W2 of the valve spring 54. Therefore, as shown in FIGS. 9A and 10A, the spool valve body 52 is maintained at the position on the first end portion side which is the initial position, and the supply/discharge port Pc communicates with the drain port Pd (the first state). As a result, the discharge pressure P (the first control oil pressure P1) is not introduced into the first control hydraulic chamber PR1, and the cam ring 4 is maintained as it is in the maximum eccentric state according to the set load W1 of the coil spring SP.

On the other hand, in a section in which the engine rotation speed N is smaller than the rotation speed Nc, by steplessly (continuously) changing the current value (the duty ratio Dt) of the exciting current supplied to the solenoid part 6, the eccentric amount Δ of the cam ring 4 can be controlled. More specifically, for instance, when maintaining the discharge pressure P at the second engine required oil pressure P2, the duty ratio Dt of the exciting current supplied to the solenoid part 6 is set to 50%. With this, a resultant force of a hydraulic force Po of the discharge pressure P and the electromagnetic force Pm of the solenoid part 6 becomes greater than the set load W2 of the valve spring 54. Then, as shown in FIG. 9B, the spool valve body 52 moves to the second end portion side, communication between the supply/discharge port Pc and the drain port Pd is interrupted, and the introduction port Pb and the supply/discharge port Pc communicate with each other (the second state). As a result, in the section d in FIG. 7, the discharge pressure P (the first control oil pressure P1) is introduced into the first control hydraulic chamber PR1, and the eccentric amount Δ of the cam ring 4 decreases according to this discharge pressure P (this first control oil pressure P1) and the cam ring 4 is brought to a minimum eccentric state, then the discharge pressure P is maintained at the second engine required oil pressure P2.

Here, in the section d, movement of the spool valve body 52 to the second end portion side according to the increase of the discharge pressure P and movement of the spool valve body 52 to the first end portion side caused by the fact that the spool valve body 52 moves to the second end portion side and the cam ring 4 is brought to the minimum eccentric state are alternately continuously repeated. In this way, a state in which the supply/discharge port Pc and the introduction port Pb communicate with each other and a state in which the supply/discharge port Pc and the drain port Pd communicate with each other are alternately continuously repeated, thereby maintaining the discharge pressure P at the second engine required oil pressure P2.

Afterwards, when the discharge pressure P reaches the third engine required oil pressure P3, in a state in which the duty ratio Dt of the exciting current supplied to the solenoid part 6 is 0%, the hydraulic force Po of the discharge pressure P becomes greater than the set load W2 of the valve spring 54. As a result, as shown in FIG. 10B, the spool valve body 52 moves to the second end portion side, communication between the supply/discharge port Pc and the drain port Pd is interrupted, and the introduction port Pb and the supply/discharge port Pc communicate with each other. As a result, in the section f in FIG. 7, the discharge pressure P (the first control oil pressure P1) is introduced into the first control hydraulic chamber PR1, and the eccentric amount Δ of the cam ring 4 decreases according to this discharge pressure P (this first control oil pressure P1) and the cam ring 4 is brought to the minimum eccentric state, then the discharge pressure P is maintained at the third engine required oil pressure P3.

Also in the section f, similarly to the above section d, movement of the spool valve body 52 to the second end portion side according to the increase of the discharge pressure P and movement of the spool valve body 52 to the first end portion side caused by the fact that the spool valve body 52 moves to the second end portion side and the cam ring 4 is brought to the minimum eccentric state are alternately continuously repeated. In this way, the state in which the supply/discharge port Pc and the introduction port Pb communicate with each other and the state in which the supply/discharge port Pc and the drain port Pd communicate with each other are alternately continuously repeated, thereby maintaining the discharge pressure P at the third engine required oil pressure P3.

Operation and Effect of the Present Embodiment

In the conventional variable displacement oil pump, an arm portion provided at an outer circumferential side of a cam ring so as to protrude from the outer circumferential side and a coil spring forcing the cam ring are arranged inside a pump housing so as to overlap a suction portion that sucks oil. Because of this, for the conventional variable displacement oil pump, there is room for improvement in that the arm portion of the cam ring and the coil spring cause increase in suction resistance then this reduces a suction performance of the pump.

In contrast to this, the variable displacement oil pump VP1 according to the present embodiment has: the housing 1 having the pump accommodating portion 110; the cam ring 4, as the adjusting member, provided in the pump accommodating portion 110 so as to be able to pivot (rock or swing) on the pivot (a rocking pivot or a swinging pivot), as a rotation shaft, provided at the pump accommodating portion 110; the pump member 3 accommodated inside the cam ring 4 and driven and rotated by the drive shaft 2 passing through the rotation center Z that is eccentric to the center of the inner circumference of the cam ring 4 (the center O of the pump member accommodating portion 41), wherein the plurality of pump chambers 30, as the plurality of working chambers, are defined between the pump member 3 and the cam ring 4, oil is sucked into some pump chambers 30 of the plurality of pump chambers 30 through the suction portion (the first and second suction ports 114, 124 and the inlet 124*a*) that is provided so as to straddle the cam ring 4 (so as to stretch across the cam ring 4) in the radial direction of the drive shaft 2 by or according to the rotation of the pump member 3, and oil in the some pump chambers 30 of the plurality of pump chambers 30 is discharged through the discharge portion (the first and second discharge ports 115, 125, the discharge port extension portion 115*a* and the outlet 115*b*) that is provided so as to straddle the cam ring 4 (so as to stretch across the cam ring 4) in the radial direction by or according to the rotation of the pump member 3; the first control hydraulic chamber PR1 formed between the pump accommodating portion 110 and the cam ring 4 in the radial direction, wherein a volume of the first control hydraulic chamber PR1 increases when oil discharged from the discharge portion (the first and second discharge ports 115, 125, the discharge port extension portion 115*a* and the outlet 115*b*) is led to the first control hydraulic chamber PR1 and the cam ring 4 moves in the direction in which the eccentric amount Δ of the center of the inner circumference of the cam ring 4 (the center O of the pump member accommodating portion 41) from the rotation center Z of the drive shaft 2 decreases; and the coil spring SP, as the urging member, forcing the cam ring 4 in the direction in which the eccentric amount Δ of the center of the inner circumference of the cam ring 4 (the center O of the pump member accommodating portion 41) from the rotation center Z of the drive shaft 2 increases by contacting the cam ring 4, wherein the coil spring SP is provided between the pump accommodating portion 110 and the cam ring 4 and located at the position that faces the drive shaft 2 in the radial direction and that does not overlap the suction portion (the first and second suction ports 114, 124 and the inlet 124*a*) when viewed from the axial direction along the drive shaft 2.

As described above, in the variable displacement oil pump VP1 according to the present embodiment, a structure (a structural component) corresponding to the arm portion of the cam ring of the conventional variable displacement oil pump, which overlaps the first and second suction ports 114, 124 and the inlet 124*a* corresponding to the suction portion and consequently tends to cause increase in suction resistance, is removed. Further, in the variable displacement oil pump VP1 according to the present embodiment, the coil spring SP is provided at the position that does not overlap the first and second suction ports 114, 124 and the inlet 124*a* corresponding to the suction portion when viewed from the axial direction along the drive shaft 2. Therefore, in the variable displacement oil pump VP1, there is no risk that flow of the oil sucked into the pump chambers 30 located in the suction region through the inlet 124*a* and the first and second suction ports 114, 124 will be interrupted by the coil spring SP. With this, in the variable displacement oil pump VP1, the suction resistance during the pump operation is reduced, then the suction performance of the pump can be improved.

Here, in terms of arrangement in which the coil spring SP is provided at the position that does not overlap the first and second suction ports 114, 124 and the inlet 124*a*, even in a case where the coil spring SP is arranged at an outer side (a radially outer side) with respect to the first and second suction ports 114, 124 and the inlet 124*a*, reduction in the suction resistance during the pump operation is possible. However, in the case where the coil spring SP is arranged at the outer side with respect to the first and second suction ports 114, 124 and the inlet 124*a*, it is necessary to enlarge the housing 1 by a size corresponding to this outer-side-arrangement of the coil spring SP, which consequently leads to increase in size of the pol pump. Therefore, this is not an appropriate arrangement.

In contrast to this, the variable displacement oil pump VP1 according to the present embodiment has the configuration or structure in which the coil spring SP is arranged at the position facing the drive shaft 2 in the radial direction of the cam ring 4, and the coil spring SP gives the urging force (the set load W1) to the cam ring 4 by contacting the middle position of the side portion of the cam ring 4. Therefore, as compared with the conventional variable displacement oil pump having the configuration or structure in which the urging force of the coil spring is given to the cam ring through the arm portion extending outwards (radially outwards) with respect to the cam ring, it is possible to enhance flexibility of layout of the pump member 3, the suction portion (the first and second suction ports 114, 124 and the inlet 124*a*) and the discharge portion (the first and second discharge ports 115, 125, the discharge port extension portion 115*a* and the outlet 115*b*) including the coil spring SP. Also, reduction in size of the variable displacement oil pump VP1 can be achieved.

Further, even by using a sliding cam ring and directly forcing an annular portion of the cam ring by the coil spring, the structure (the structural component) corresponding to the arm portion of the cam ring of the conventional variable displacement oil pump can be removed. However, in the case where the sliding cam ring is used, discharge pressure led to the first control hydraulic chamber acts in a direction orthogonal to a moving direction (a sliding direction) of the cam ring. Because of this, by the urging force based on the internal pressure of the first control hydraulic chamber, the seal portions of the cam ring are pressed against the peripheral wall (an inside wall of the pump accommodating portion), facing the first control hydraulic chamber with respect to the drive shaft, of the housing. As a consequence, friction caused by the seal members during cam ring action (cam ring movement) is increased, then response of the cam ring is reduced. In addition, due to the increase of the friction, there is a risk that wear of the seal members will increase.

In contrast to this, the variable displacement oil pump VP1 according to the present embodiment uses the pivoting cam ring 4 (the rocking or swinging cam ring 4). Therefore, a forcing direction based on the internal pressure of the first control hydraulic chamber PR1 and a moving direction (a sliding direction) of the cam ring 4 coincide with each other. This does not pose a risk of increase in friction of the first and second seal members S1, S2 defining the suction side chamber IH and increase (acceleration) in (of) wear of the first and second seal members S1, S2. As a result, it is possible for the variable displacement oil pump VP1 to improve the response of the cam ring 4 and increase durability of the pump (the pump device).

Further, in the variable displacement oil pump VP1 according to the present embodiment, the coil spring SP is accommodated in the spring accommodating chamber SR, as an urging member accommodating chamber, liquid-tightly sealed between the pump accommodating portion 110 and the cam ring 4.

As described above, in the present embodiment, the coil spring SP is accommodated in the spring accommodating chamber SR liquid-tightly sealed between the pump accommodating portion 110 and the cam ring 4. This therefore suppresses inflow of oil sucked through the inlet 124*a* and the first and second suction ports 114, 124 into the spring accommodating chamber SR. Thus, there is no risk that flow of oil introduced through the inlet 124*a* and the first and second suction ports 114, 124 will be interrupted by the coil spring SP. With this, flow of the oil at the suction side is improved, then the suction performance of the pump can be further improved.

Further, in the variable displacement oil pump VP1 according to the present embodiment, the distance De between the discharge side seal portion (the third seal member S3) liquid-tightly sealing the clearance between the discharge portion (the first and second discharge ports 115, 125, the discharge port extension portion 115*a* and the outlet 115*b*) and the spring accommodating chamber SR and the center of the coil spring SP is shorter than the distance Di between the suction side seal portion (the second seal member S2) liquid-tightly sealing the clearance between the suction portion (the inlet 124*a* and the first and second suction ports 114, 124) and the spring accommodating chamber SR and the center of the coil spring SP.

As described above, in the present embodiment, a distance between the discharge side chamber EH and the spring accommodating chamber SR is set to be shorter than a distance between the suction side chamber IH and the spring accommodating chamber SR. That is, in the present embodiment, a surplus space formed between the spring accommodating chamber SR and the discharge side chamber EH can be reduced (cut) by a size based on an arrangement in which the spring accommodating chamber SR can be closer to the discharge side chamber EH. With this, a larger discharge side chamber EH by a size corresponding to the cut surplus space can be secured, then a discharge performance of the pump can be improved.

Further, the variable displacement oil pump VP1 according to the present embodiment further has the suction discharge passage that is the passage formed separately from the first control hydraulic chamber PR1 and connecting from the suction portion (the inlet 124*a* and the first and second suction ports 114, 124) to the discharge portion (the first and second discharge ports 115, 125, the discharge port extension portion 115*a* and the outlet 115*b*) through the plurality of pump chambers 30. And, the suction discharge passage is provided between the first control hydraulic chamber PR1 and the spring accommodating chamber SR.

As described above, in the present embodiment, the suction discharge passage is provided between the first control hydraulic chamber PR1 and the spring accommodating chamber SR. Therefore, the space inside the housing 1 can be effectively utilized. Also, efficiency of the oil flow from the suction side chamber IH to the discharge side chamber EH can be increased. These leads to reduction in size of the variable displacement oil pump VP1.

In particular, in the present embodiment, the suction side cut-out grooves 461*a* are formed at the section, facing the suction side chamber IH, of the cam ring 4, and also the discharge side cut-out grooves 462*a* are formed at the section, facing the discharge side chamber EH, of the cam ring 4. That is, in the present embodiment, the suction side chamber IH and each pump chamber 30 located in the suction region can communicate with each other through the suction side cut-out grooves 461*a*, and the discharge side chamber EH and each pump chamber 30 located in the discharge region can communicate with each other through the discharge side cut-out grooves 462*a*. In other words, in the present embodiment, in terms of arrangement of the communication between the suction side chamber IH and each pump chamber 30 located in the suction region and the communication between the discharge side chamber EH and each pump chamber 30 located in the discharge region, there is no need to form an oil passage(s) that bypasses the cam ring 4. Therefore, the configuration or structure of the hosing 1 is simplified, thereby increasing productivity of the variable displacement oil pump VP1 and reducing the manufacturing cost.

Further, in the variable displacement oil pump VP1 according to the present embodiment, the contact surface (the spring contact portion 440) of the cam ring 4 with the coil spring SP is parallel to the line X connecting the pivot (the rocking pivot or the swinging pivot) of the cam ring 4 and the rotation center Z of the drive shaft 2 in the state in which the center of the inner circumference of the cam ring 4 (the center O of the pump member accommodating portion 41) is eccentric to the rotation center Z of the drive shaft 2.

As described above, in the present embodiment, the spring contact portion 440 of the cam ring 4 is parallel to the line X connecting the pivot (the rocking pivot or the swinging pivot) of the cam ring 4 and the rotation center Z of the drive shaft 2 when the cam ring 4 is eccentric. Therefore, the load (the set load W1) applied by the coil spring SP can act on the cam ring 4 efficiently. With this, the set load W1 of the coil spring SP can be reduced, thereby contributing to reduction in size of the coil spring SP, which further contributes reduction in size of the variable displacement oil pump VP1.

Further, in the variable displacement oil pump VP1 according to the present embodiment, the contact surface (the spring contact portion 440) of the cam ring 4 with the coil spring SP is parallel to the line X connecting the pivot (the rocking pivot or the swinging pivot) of the cam ring 4 and the rotation center Z of the drive shaft 2 in the state in which the center of the inner circumference of the cam ring 4 (the center O of the pump member accommodating portion 41) is most eccentric to the rotation center Z of the drive shaft 2.

As described above, in the present embodiment, in particular, the spring contact portion 440 of the cam ring 4 is parallel to the line X connecting the pivot (the rocking pivot or the swinging pivot) of the cam ring 4 and the rotation center Z of the drive shaft 2 in the maximum eccentric state of the cam ring 4. Therefore, the load (the set load W1) applied by the coil spring SP can act on the cam ring 4 most efficiently. As a result, the set load W1 of the coil spring SP can be set to the minimum, thereby reducing a size of the coil spring SP to the utmost.

Further, in the variable displacement oil pump VP1 according to the present embodiment, the coil spring SP forces the cam ring 4 toward the drive shaft 2.

As described above, in the present embodiment, since the coil spring SP forces the cam ring 4 toward the drive shaft 2, a forcing direction of the coil spring SP and an eccentric direction of the cam ring 4 substantially coincide with each other. Therefore, the urging force of the coil spring SP can be efficiently converted into the eccentric movement of the cam ring 4. With this, the set load W1 of the coil spring SP can be reduced, thereby contributing to reduction in size of the coil spring SP.

Further, in the variable displacement oil pump VP1 according to the present embodiment, the cam ring 4 is formed so as to surround an entire circumference of the pivot (the pivot pin 40) in the moving (pivoting) direction of the cam ring 4.

More specifically, the pivot supporting portion 42 of the cam ring 4 is formed into the cylindrical shape (the tubular shape) that surrounds the entire circumference of the pivot pin 40 forming the pivot of the cam ring 4. With this structure, stable pivotal movement of the cam ring 4 can be achieved.

Further, from another viewpoint, the variable displacement oil pump VP1 according to the present embodiment has: the housing 1 having the pump accommodating portion 110; the cam ring 4, as the adjusting member, provided in the pump accommodating portion 110 so as to be able to pivot (rock or swing) on the pivot (a rocking pivot or a swinging pivot), as a rotation shaft, provided at the pump accommodating portion 110; the pump member 3 accommodated at the inside of the cam ring 4 and driven and rotated by the drive shaft 2 passing through the rotation center Z that is eccentric to the center of the inner circumference of the cam ring 4 (the center O of the pump member accommodating portion 41), wherein the plurality of pump chambers 30, as the plurality of working chambers, are defined between the pump member 3 and the cam ring 4, oil is sucked into some pump chambers 30 of the plurality of pump chambers 30 through the suction portion (the first and second suction ports 114, 124 and the inlet 124*a*) that is provided so as to straddle the cam ring 4 (so as to stretch across the cam ring 4) in the radial direction of the drive shaft 2 by or according to the rotation of the pump member 3, and oil in the some pump chambers 30 of the plurality of pump chambers 30 is discharged through the discharge portion (the first and second discharge ports 115, 125, the discharge port extension portion 115*a* and the outlet 115*b*) that is provided so as to straddle the cam ring 4 (so as to stretch across the cam ring 4) in the radial direction; the first control hydraulic chamber PR1 formed between the pump accommodating portion 110 and the cam ring 4 in the radial direction, wherein a volume of the first control hydraulic chamber PR1 increases when oil discharged from the discharge portion (the first and second discharge ports 115, 125, the discharge port extension portion 115*a* and the outlet 115*b*) is led to the first control hydraulic chamber PR1 and the cam ring 4 moves in the direction in which the eccentric amount Δ of the center of the inner circumference of the cam ring 4 (the center O of the pump member accommodating portion 41) from the rotation center Z of the drive shaft 2 decreases; the spring accommodating chamber SR, as the urging member accommodating chamber, formed between the pump accommodating portion 110 and the cam ring 4 in the radial direction and liquid-tightly sealed with respect to the suction portion (the first and second suction ports 114, 124 and the inlet 124*a*) and the discharge portion (the first and second discharge ports 115, 125, the discharge port extension portion 115*a* and the outlet 115*b*); and the coil spring SP, as the urging member, forcing the cam ring 4 in the direction in which the eccentric amount Δ of the center of the inner circumference of the cam ring 4 (the center o of the pump member accommodating portion 41) from the rotation center Z of the drive shaft 2 increases by contacting the cam ring 4, wherein the coil spring SP is accommodated in the spring accommodating chamber SR and located at the position that does not overlap the suction portion (the first and second suction ports 114, 124 and the inlet 124*a*) when viewed from the axial direction along the drive shaft 2.

As described above, in the variable displacement oil pump VP1 according to the present embodiment, the coil spring SP is provided at the position that does not overlap the first and second suction ports 114, 124 and the inlet 124*a* corresponding to the suction portion when viewed from the axial direction along the drive shaft 2. Therefore, in the variable displacement oil pump VP1, there is no risk that flow of the oil sucked through the inlet 124*a* and the first and second suction ports 114, 124 will be interrupted by the coil spring SP. Hence, the suction resistance during the pump operation is reduced, then the suction performance of the pump can be improved.

Further, in the variable displacement oil pump VP1 according to the present embodiment, the coil spring SP is accommodated in the spring accommodating chamber SR liquid-tightly sealed between the pump accommodating portion 110 and the cam ring 4. This therefore suppresses inflow of oil sucked through the inlet 124*a* and the first and second suction ports 114, 124 into the spring accommodating chamber SR. Thus, there is no risk that flow of oil introduced through the inlet 124*a* and the first and second suction ports 114, 124 will be interrupted by the coil spring SP. With this, flow of the oil at the suction side is improved, then the suction performance of the pump can be further improved.

Second Embodiment

FIGS. 11 to 14 show a second embodiment of the variable displacement oil pump according to the present invention. In the second embodiment, configuration in terms of usage of the spring accommodating chamber SR of the first embodiment is changed. The other configurations or structures are the same as those of the first embodiment. Therefore, the same configurations or structures are denoted by the same reference signs, and their descriptions are omitted here.

Figure 11:
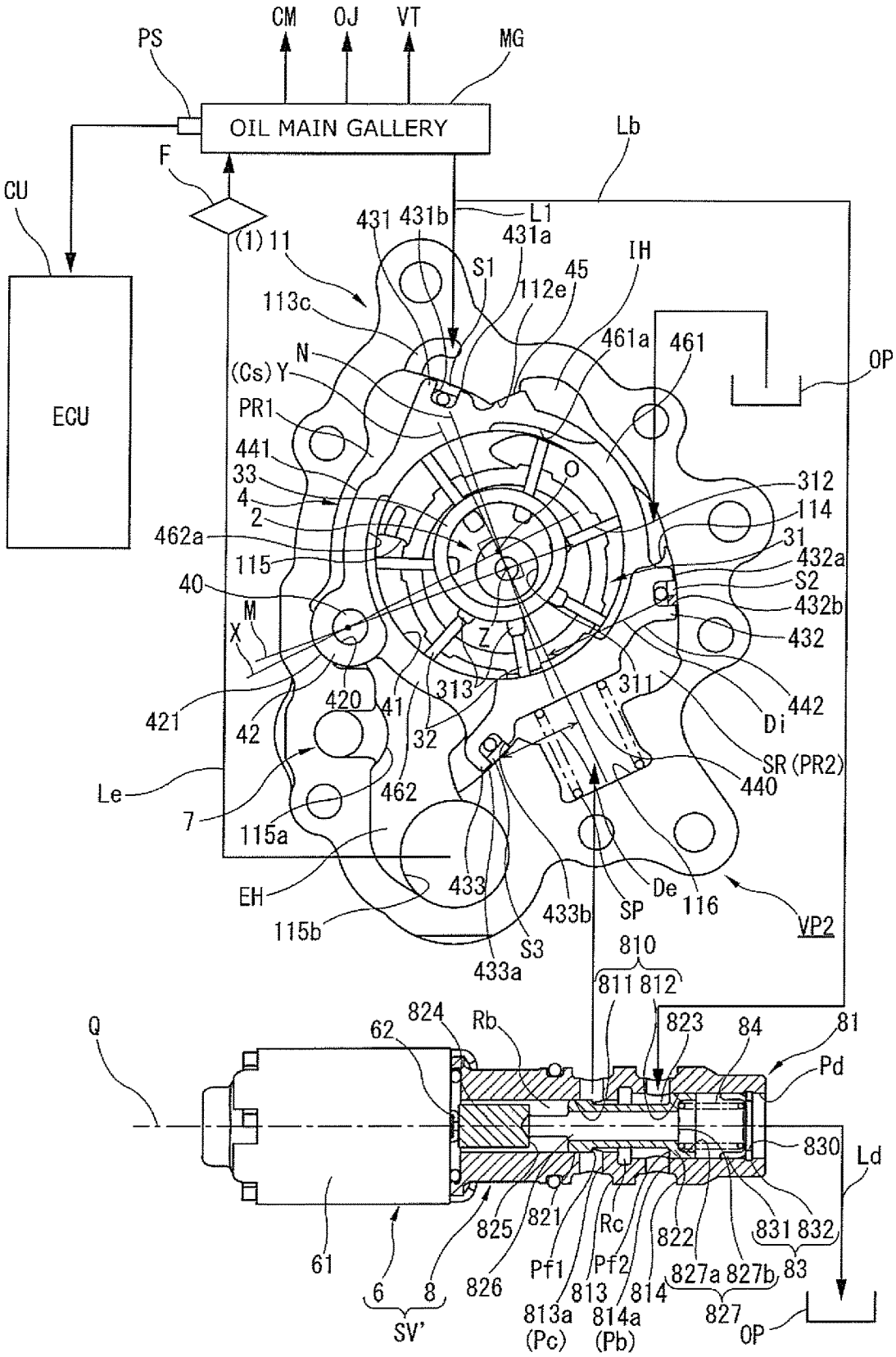
FIG. 11 is a plan view of a variable displacement oil pump according to a second embodiment of the present invention with a second housing removed.

FIG. 11 illustrates a configuration of a variable displacement oil pump VP2 according to the present embodiment. FIGS. 12 to 14 are drawings for describing variable displacement control of the variable displacement oil pump VP2 according to the present embodiment.

(Configuration of Oil Pump)

As illustrated in FIG. 11, the variable displacement oil pump VP2 according to the present embodiment is configured so that in addition to the first control hydraulic chamber PR1, oil is also introduced into the spring accommodating chamber SR, and the spring accommodating chamber SR functions as a second control hydraulic chamber PR2. More specifically, the first control oil pressure P1 is led to the first control hydraulic chamber PR1 through the first passage L1 that is one of a bifurcated passage from the discharge pressure introduction passage Lb. It is noted that this first control oil pressure P1 led to the first control hydraulic chamber PR1 is substantially the same as the discharge pressure P led to the main gallery MG. The first control oil pressure P1 led to the first control hydraulic chamber PR1 acts on the first pressure receiving surface 441 that is the outer circumferential surface, facing the first control hydraulic chamber PR1, of the cam ring 4 and that is located (in the first region) between the pivot supporting portion 42 and the first seal forming portion 431 (the first seal member S1). On the other hand, a second control oil pressure P2 depressurized through a control valve SV' is led to the second control hydraulic chamber PR2 through a second passage L2 that is the other of the bifurcated passage from the discharge pressure introduction passage Lb and the spring chamber communication hole 127. The second control oil pressure P2 led to the second control hydraulic chamber PR2 acts on a second pressure receiving surface 442 that is the outer circumferential surface, facing the second control hydraulic chamber PR2, of the cam ring 4 and that is located (in a second region) between the second seal forming portion 432 (the second seal member S2) and the third seal forming portion 433 (the third seal member S3). In this way, the first control oil pressure P1 in the first control hydraulic chamber PR1 acts on the first pressure receiving surface 441 and the second control oil pressure P2 in the second control hydraulic chamber PR2 acts on the second pressure receiving surface 442, then a moving force (a pivoting force, a rocking force or a swinging force) is given to the cam ring 4.

In the present embodiment, regarding the pressure receiving surfaces of the cam ring 4, an area of the first pressure receiving surface 441 and an area of the second pressure receiving surface 442 are set to be equal to each other. However, the areas of the first pressure receiving surface 441 and the second pressure receiving surface 442 can be set arbitrarily. A case where the area of the second pressure receiving surface 442 is set to be smaller than the area of the first pressure receiving surface 441 will be described in the following third embodiment according to the present invention. On the other hand, a case where the area of the first pressure receiving surface 441 is set to be smaller than the area of the second pressure receiving surface 442 will be described in the following fourth embodiment according to the present invention.

Further, in the present embodiment, the spring chamber communication hole 127 for introducing the second control oil pressure P2 into the second control hydraulic chamber PR2 is provided at a position that is shifted to the discharge side (that is eccentric toward the discharge side) and that faces the coil spring SP in the second control hydraulic chamber PR2. In this manner, it is desirable that the spring chamber communication hole 127 be provided at a position close to the discharge side, i.e. a position that is relatively close to the supply/discharge port Pc of the control valve SV'. By providing the spring chamber communication hole 127 at the position relatively close to the supply/discharge port Pc of the control valve SV', response of the pivoting control (the rocking or swinging control) of the cam ring 4 can be improved.

With this configuration or structure, in the variable displacement oil pump VP2, when an urging force based on an internal pressure (the first control oil pressure P1) of the first control hydraulic chamber PR1 is smaller than a resultant force of an urging force based on an internal pressure (the second control oil pressure P2) of the second control hydraulic chamber PR2 and the set load W1 of the coil spring SP, the cam ring 4 is brought to the maximum eccentric state as shown in FIG. 11. On the other hand, in the variable displacement oil pump VP2, when the discharge pressure P is increased and the urging force based on the internal pressure (the first control oil pressure P1) of the first control hydraulic chamber PR1 becomes greater than the resultant force of the urging force based on the internal pressure (the second control oil pressure P2) of the second control hydraulic chamber PR2 and the set load W1 of the coil spring SP, the cam ring 4 moves in the concentric direction according to the discharge pressure P.

(Configuration of Control Valve)

In the variable displacement oil pump VP2, as shown in FIG. 11, introduction of oil (the first control oil pressure P1) into the first control hydraulic chamber PR1 and introduction of oil (the second control oil pressure P2) into the second control hydraulic chamber PR2 are controlled by the control valve SV' which corresponds to a control mechanism. The control valve SV' is a solenoid valve driven and controlled by the control device CU that performs engine control. More specifically, the control valve SV' has a valve part 8 for performing switching control of the second passage L2 and a solenoid part 6 provided at one end portion of the valve part 8 and performing the switching control of the valve part 8 according to exciting current that is output by the control device CU.

The valve part 8 is a so-called three-way valve, and has a valve case 81, a spool valve body 82, a retainer member 83 and a valve spring 84. The valve part 8 could be provided integrally with the variable displacement oil pump VP2 so as to be mounted in the housing 1, or might be provided as a separate valve independently of the variable displacement oil pump VP2.

The valve case 81 is made of predetermined metal material, for instance, aluminium alloy material, and has a substantially cylindrical shape (a substantially tubular shape) whose both end portions in a direction of a center axis Q are open. The valve case 81 has, at an inside thereof, a valve body accommodating portion 810. The valve body accommodating portion 810 is formed by a stepped penetration hole penetrating the valve case 81 along the direction of the center axis Q of the valve case 81. That is, the valve body accommodating portion 810 has a first valve body sliding-contact portion 811 at one end side in the center axis Q direction and a second valve body sliding-contact portion 812 having a larger diameter than that of the first valve body sliding-contact portion 811 at the other end side in the center axis Q direction. An opening of the valve body accommodating portion 810 at the first valve body sliding-contact portion 811 side is closed by the solenoid part 6. On the other hand, an opening of the valve body accommodating portion 810 at the second valve body sliding-contact portion 812 side functions as a drain port Pd that discharges oil of an after-described spring accommodating chamber 85, and is open to the drain passage Ld. Here, the drain port Pd could be directly open to the oil pan OP corresponding to the low pressure part, without being open to the drain passage Ld. Further, as long as the drain port Pd communicates with the low pressure part, not only the configuration in which the drain port Pd is open to the oil pan OP corresponding to atmospheric pressure, but also, for instance, a configuration in which the drain port Pd communicates with a portion close to the inlet 124*a* which is at a negative pressure, could be applied. In the following description, for the sake of convenience in description of the valve part 8, an end portion at the first valve body sliding-contact portion 811 side (a left side in FIG. 11) is referred to as a "first end portion", and an end portion at the second valve body sliding-contact portion 812 side (a right side in FIG. 11) is referred to as a "second end portion".

A first annular groove 813 formed by cutting out an outer circumferential surface of the valve case 81 along a circumferential direction is formed at an outer circumferential side of the first valve body sliding-contact portion 811. Further, a plurality of first valve holes 813*a* connecting an inside and an outside of the valve body accommodating portion 810 in a radial direction of the valve case 81 which is orthogonal to the center axis Q are formed at a bottom of the first annular groove 813. Each of the first valve holes 813*a* is formed by a round hole that is substantially circular in plan view, and functions as a supply/discharge port Pc that supplies and discharges oil (the second control oil pressure P2) to and from the second control hydraulic chamber PR2 through the second passage L2.

Likewise, a second annular groove 814 formed by cutting out the outer circumferential surface of the valve case 81 along the circumferential direction is formed at an outer circumferential side of the second valve body sliding-contact portion 812. Further, a plurality of second valve holes 814*a* connecting the inside and the outside of the valve body accommodating portion 810 in the radial direction of the valve case 81 which is orthogonal to the center axis Q are formed at a bottom of the second annular groove 814. Each of the second valve holes 814*a* is formed by a round hole that is substantially circular in plan view, and functions as an introduction port Pb that introduces oil (the discharge pressure P) from the discharge pressure introduction passage Lb.

The spool valve body 82 has a stepped cylindrical shape (a stepped tubular shape) having different outside diameters in the center axis Q direction that is a moving direction of the spool valve body 82, and is slidably accommodated in the valve body accommodating portion 810 of the valve case 81. More specifically, the spool valve body 82 has a first land portion 821 coming into sliding-contact with the first valve body sliding-contact portion 811 and a second land portion 822 having a larger diameter than that of the first land portion 821 and coming into sliding-contact with the second valve body sliding-contact portion 812. Further, a middle shaft portion 823 having an outside diameter that is smaller than those of the first land portion 821 and the second land portion 822 is formed between the first land portion 821 and the second land portion 822. That is, the middle shaft portion 823 defines an intermediate chamber Rc between the middle shaft portion 823 and the valve body accommodating portion 810 in the radial direction of the valve case 81.

The first land portion 821 and the second land portion 822 that face each other in the center axis Q direction in the intermediate chamber Rc form pressure receiving surfaces that receive oil pressure led from the second valve holes 814*a*. More specifically, the second land portion 822 has an outside diameter that is larger than that of the first land portion 821, and a second pressure receiving surface Pf2 formed by the second land portion 822 is formed to be greater than a first pressure receiving surface Pf1 formed by the first land portion 821. That is, by a difference in pressure receiving area between these first pressure receiving surface Pf1 and second pressure receiving surface Pf2, the oil pressure introduced from the second valve holes 814*a* into the intermediate chamber Rc acts on the second pressure receiving surface Pf2 that is great relative to the first pressure receiving surface Pf1, then the spool valve body 82 is pressed to the second end portion side.

The spool valve body 82 also has, at the first end portion side with respect to the first land portion 821, a shaft end portion 824 having an outside diameter that is smaller than that of the first land portion 821. The shaft end portion 824 defines a back pressure chamber Rb between the shaft end portion 824 and the valve body accommodating portion 810 in the radial direction of the valve case 81. Further, an annular hole 825 formed by annularly cutting out an outer circumferential side of the spool valve body 82 is formed between the shaft end portion 824 of the spool valve body 82 and the first land portion 821. The annular hole 825 communicates with the after-described spring accommodating chamber 85 through an inside passage 826 formed so as to be open at an inside of the spool valve body 82 to the second end portion side. With this structure, oil of the second control hydraulic chamber PR2 led to the back pressure chamber Rb through the first valve holes 813*a* is led to the spring accommodating chamber 85 through the annular hole 825 and the inside passage 826, and discharged to the oil pan OP through the drain port Pd and the drain passage Ld.

The spool valve body 82 further has, at an end portion thereof on the second land portion 822 side which faces the retainer member 83, a spring supporting portion 827 that supports a first end portion, facing the spool valve body 82, of the valve spring 84. The spring supporting portion 827 is formed by expanding an inner circumferential side of the spool valve body 82 stepwise toward the second land portion 822 side. The spring supporting portion 827 has a tubular spring surrounding portion 827*a* and a flat spring supporting surface 827*b*. With this structure, the spring supporting portion 827 supports the first end portion of the valve spring 84 by the spring supporting surface 827*b* while surrounding an outer circumferential side of the first end portion of the valve spring 84 by the spring surrounding portion 827*a*.

The retainer member 83 has a tubular portion 831 and a bottom wall portion 832 closing an outer end portion of the tubular portion 831, and is formed into a substantially closed-bottomed tubular shape. The retainer member 83 is fitted into an opening end portion at the second end portion side of the valve case 81 so that an opening of the tubular portion 831 faces the spring supporting portion 827 of the spool valve body 82. With this structure, the retainer member 83 supports a second end portion of the valve spring 84 by an inner end surface of the bottom wall portion 832 while surrounding an outer circumferential side of the second end portion of the valve spring 84 by the tubular portion 831. The retainer member 83 also has a round retainer opening 830 at a middle position of the bottom wall portion 832. That is, the retainer opening 830 penetrates the bottom wall portion 832, and connects the second valve holes 814*a* and the drain port Pd.

The valve spring 84 is a well-known compression coil spring. The valve spring 84 is inserted in the spring accommodating chamber 85 defined between the spool valve body 82 and the retainer member 83 with a predetermined preload (a set load W2). With this, the valve spring 84 constantly forces the spool valve body 82 to the first end portion side according to the set load W2.

(Description of Operation of Control Valve)

Figure 12A:
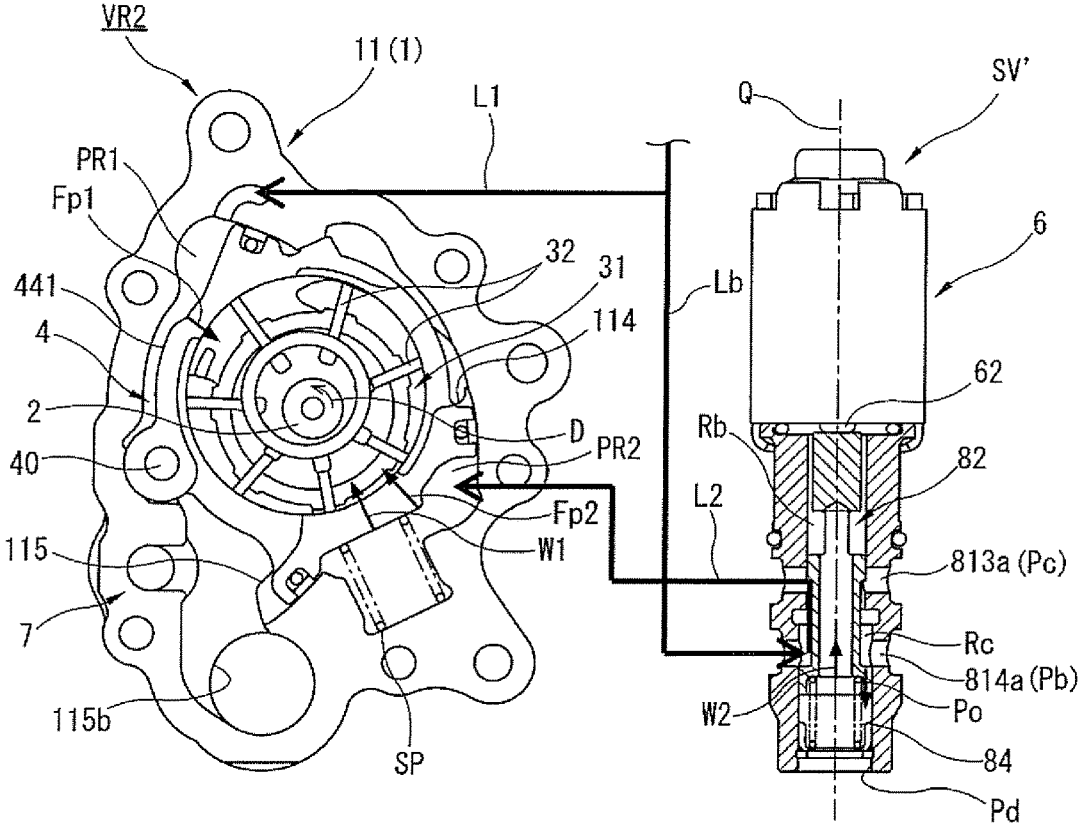
FIGS. 12A and 12B are hydraulic circuit diagrams showing respective operating states of the variable displacement oil pump according to the second embodiment of the present invention.
Figure 12B:
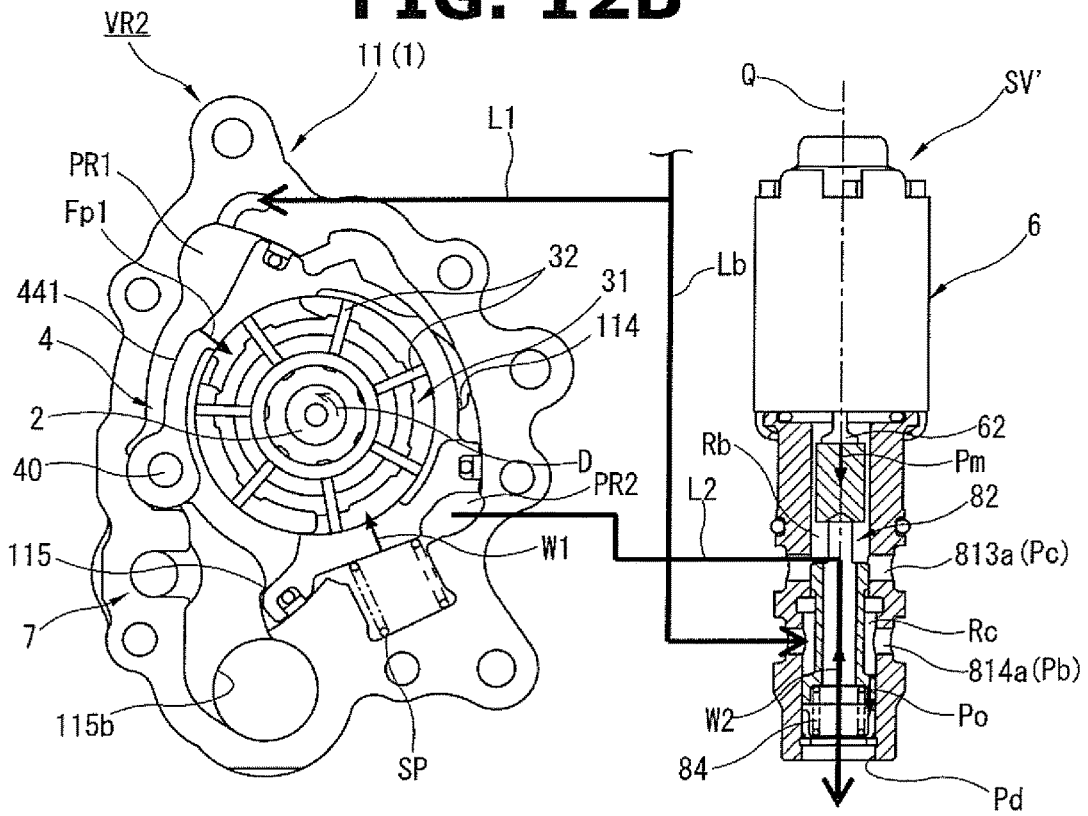
Figure 13A:
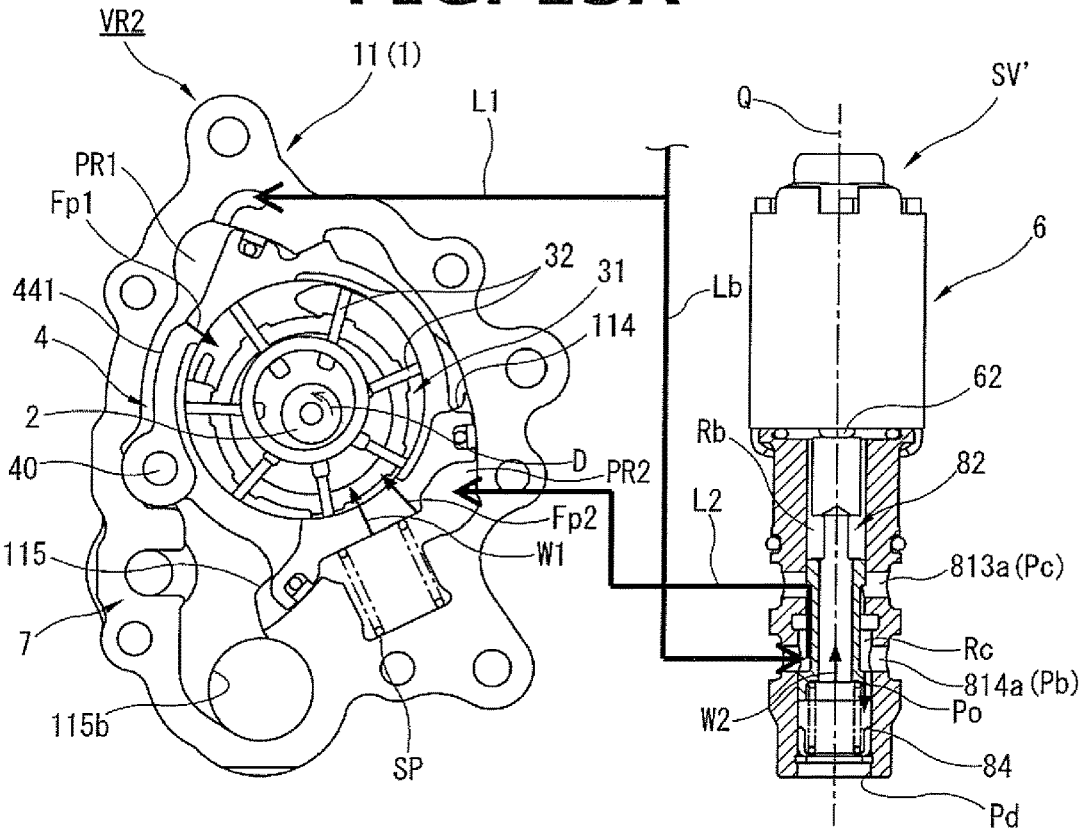
FIGS. 13A and 13B are hydraulic circuit diagrams showing respective operating states of the variable displacement oil pump according to the second embodiment of the present invention.
Figure 13B:
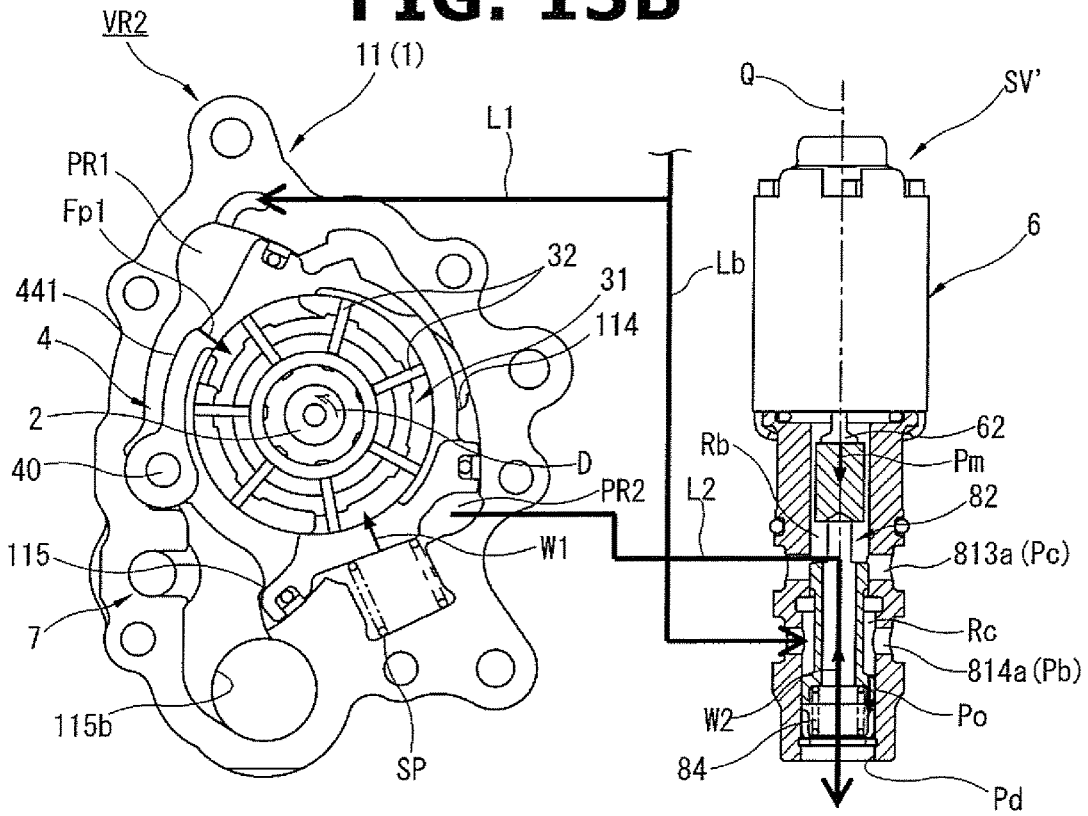
Figure 14A:
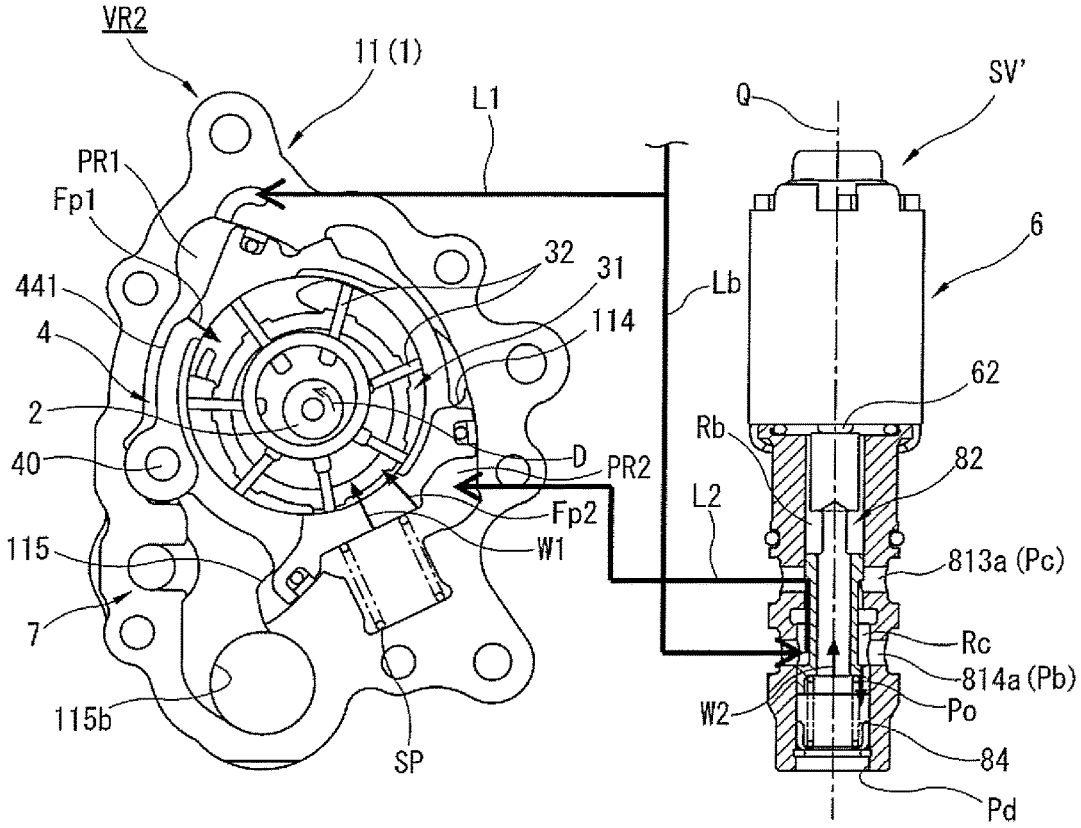
FIGS. 14A and 14B are hydraulic circuit diagrams showing respective operating states of the variable displacement oil pump according to the second embodiment of the present invention.
Figure 14B:
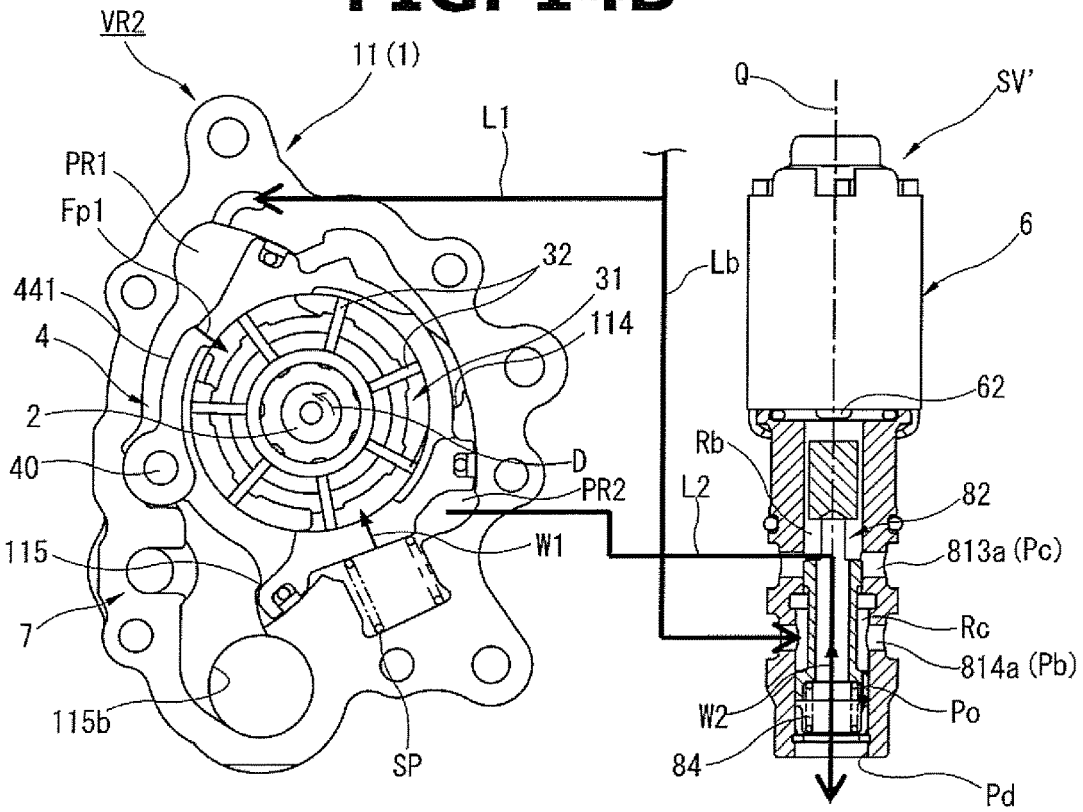

FIGS. 12A and 12B are hydraulic circuit diagrams showing respective operating states of the variable displacement oil pump VP2. FIG. 12A shows a pump state of a section a in FIG. 7. FIG. 12B shows a pump state of a section b in FIG. 7. FIGS. 13A and 13B are hydraulic circuit diagrams showing respective operating states of the variable displacement oil pump VP2. FIG. 13A shows a pump state of a section c in FIG. 7. FIG. 13B shows a pump state of a section d in FIG. 7. FIGS. 14A and 14B are hydraulic circuit diagrams showing respective operating states of the variable displacement oil pump VP2. FIG. 14A shows a pump state of a section e in FIG. 7. FIG. 14B shows a pump state of a section f in FIG. 7.

That is, in the variable displacement oil pump VP2, in the section a from an engine start to a rotation speed Na, the first control oil pressure P1 is introduced into the first control hydraulic chamber PR1 through the first passage L1 branched off from the discharge pressure introduction passage Lb. Further, in the control valve SV', an urging force Po generated by the discharge pressure P acting on the second pressure receiving surface Pf2 of the spool valve body 82 is smaller than the set load W2 of the valve spring 84. Therefore, as shown in FIG. 12A, the spool valve body 82 is maintained at a position on the first end portion side which is an initial position, and the introduction port Pb and the supply/discharge port Pc communicate with each other (a first state), then the second control oil pressure P2 is introduced into the second control hydraulic chamber PR2. As a result, a resultant force of a hydraulic force Fp2 generated by the second control oil pressure P2 of the second control hydraulic chamber PR2 acting on the second pressure receiving surface 442 and the set load W1 of the coil spring SP exceeds a hydraulic force Fp1 generated by the first control oil pressure P1 of the first control hydraulic chamber PR1 acting on the first pressure receiving surface 441, and the cam ring 4 is maintained as it is in the maximum eccentric state.

At a time when the discharge pressure P reaches the first engine required oil pressure P1, when maintaining the discharge pressure P at this first engine required oil pressure P1, the duty ratio Dt of the exciting current supplied to the solenoid part 6 is set to 100%. With this, an electromagnetic force Pm generated at the solenoid part 6, i.e. a pressing force with which the rod 62 presses the spool valve body 82, becomes greater than the set load W2 of the valve spring 84. Therefore, as shown in FIG. 12B, the spool valve body 82 moves to the second end portion side, communication between the introduction port Pb and the supply/discharge port Pc is interrupted, and the supply/discharge port Pc and the drain port Pd communicate with each other (a second state). As a result, in the section b in FIG. 7, oil in the second control hydraulic chamber PR2 is discharged, and the discharge pressure P acts on only the first control hydraulic chamber PR1. Therefore, the hydraulic force Fp1 generated by the discharge pressure P introduced into the first control hydraulic chamber PR1 and acting on the first pressure receiving surface 441 exceeds the set load W1 of the coil spring SP. As a result, the eccentric amount Δ of the cam ring 4 decreases according to increase of the discharge pressure P, then the discharge pressure P gently increases.

In the variable displacement oil pump VP2, in the section c or the section e in FIG. 7 in which the engine rotation speed N is greater than the rotation speed Na and smaller than a rotation speed Nc, as shown in FIGS. 13A and 14A, the urging force Po generated by oil (the discharge pressure P) introduced from the introduction port Pb and acting on the second pressure receiving surface Pf2 of the spool valve body 82 is smaller than the set load W2 of the valve spring 84. Therefore, as shown in FIGS. 13A and 14A, the spool valve body 82 is maintained at the position on the first end portion side which is the initial position, and the introduction port Pb and the supply/discharge port Pc communicate with each other (the first state), then the second control oil pressure P2 is introduced into the second control hydraulic chamber PR2. As a result, the resultant force of the hydraulic force Fp2 generated by the second control oil pressure P2 led to the second control hydraulic chamber PR2 and acting on the second pressure receiving surface 442 and the set load W1 of the coil spring SP exceeds the hydraulic force Fp1 generated by the oil pressure in the first control hydraulic chamber PR1 acting on the first pressure receiving surface 441, and the cam ring 4 is maintained as it is in the maximum eccentric state.

On the other hand, in a section in which the engine rotation speed N is smaller than the rotation speed Nc, by steplessly (continuously) changing the current value (the duty ratio Dt) of the exciting current supplied to the solenoid part 6, the eccentric amount Δ of the cam ring 4 can be controlled. More specifically, for instance, when maintaining the discharge pressure P at the second engine required oil pressure P2, the duty ratio Dt of the exciting current supplied to the solenoid part 6 is set to 50%. With this, a resultant force of a hydraulic force Po of the discharge pressure P and the electromagnetic force Pm of the solenoid part 6 becomes greater than the set load W2 of the valve spring 84. Then, as shown in FIG. 13B, the spool valve body 82 moves to the second end portion side, communication between the introduction port Pb and the supply/discharge port Pc is interrupted, and the supply/discharge port Pc and the drain port Pd communicate with each other (the second state). As a result, in the section d in FIG. 7, oil in the second control hydraulic chamber PR2 is discharged, and the discharge pressure P acts on only the first control hydraulic chamber PR1. Therefore, the hydraulic force Fp1 generated by the discharge pressure P (the first control oil pressure P1) of the first control hydraulic chamber PR1 acting on the first pressure receiving surface 441 exceeds the set load W1 of the coil spring SP. As a result, the eccentric amount Δ of the cam ring 4 decreases according to increase of the discharge pressure P and the cam ring 4 is brought to the minimum eccentric state, then the discharge pressure P is maintained at the second engine required oil pressure P2.

Here, in the section d, movement of the spool valve body 82 to the second end portion side according to the increase of the discharge pressure P and movement of the spool valve body 82 to the first end portion side caused by the fact that the spool valve body 82 moves to the second end portion side and the cam ring 4 is brought to the minimum eccentric state are alternately continuously repeated. In this way, a state in which the supply/discharge port Pc and the introduction port Pb communicate with each other and a state in which the supply/discharge port Pc and the drain port Pd communicate with each other are alternately continuously repeated, thereby maintaining the discharge pressure P at the second engine required oil pressure P2.

Afterwards, when the discharge pressure P reaches the third engine required oil pressure P3, in a state in which the duty ratio Dt of the exciting current supplied to the solenoid part 6 is 0%, the hydraulic force Po of the discharge pressure P becomes greater than the set load W2 of the valve spring 84. Then, as shown in FIG. 14B, the spool valve body 82 moves to the second end portion side, and the supply/discharge port Pc and the drain port Pd communicate with each other. As a result, in the section f in FIG. 7, oil in the second control hydraulic chamber PR2 is discharged, and the discharge pressure P acts on only the first control hydraulic chamber PR1. Therefore, the hydraulic force Fp1 generated by the discharge pressure P (the first control oil pressure P1) of the first control hydraulic chamber PR1 acting on the first pressure receiving surface 441 exceeds the set load W1 of the coil spring SP. As a result, the eccentric amount Δ of the cam ring 4 decreases according to increase of the discharge pressure P and the cam ring 4 is brought to the minimum eccentric state, then the discharge pressure P is maintained at the third engine required oil pressure P3.

Also in the section f, similarly to the above section d, movement of the spool valve body 82 to the second end portion side according to the increase of the discharge pressure P and movement of the spool valve body 82 to the first end portion side caused by the fact that the spool valve body 82 moves to the second end portion side and the cam ring 4 is brought to the minimum eccentric state are alternately continuously repeated. In this way, the state in which the supply/discharge port Pc and the introduction port Pb communicate with each other and the state in which the supply/discharge port Pc and the drain port Pd communicate with each other are alternately continuously repeated, thereby maintaining the discharge pressure P at the third engine required oil pressure P3.

Operation and Effect of the Present Embodiment

In the variable displacement oil pump VP2 according to the present embodiment, the spring accommodating chamber SR communicates with the discharge portion (the first and second discharge ports 115, 125) through the control mechanism (the control valve SV'), or is connected to the low pressure part whose pressure is lower than that of the discharge portion (the first and second discharge ports 115, 125).

As described above, the present embodiment has a configuration in which oil (the discharge pressure P) discharged from the first and second discharge ports 115, 125 is also led to the spring accommodating chamber SR. That is, the eccentric amount Δ of the cam ring 4 can be controlled by the oil pressure led to the first control hydraulic chamber PR1 and the oil pressure led to the spring accommodating chamber SR. Therefore, even in a case where viscosity of the oil changes due to external factor such as temperature, the same oil pressure (the discharge pressure P) introduced into the first and second control hydraulic chambers PR1, PR2 acts on the first and second pressure receiving surfaces 441, 442 of the cam ring 4 respectively. In other words, since the same oil pressure (the discharge pressure P) acts on the first and second pressure receiving surfaces 441, 442, the oil pressure (the discharge pressure P) does not act on only one of the first and second pressure receiving surfaces 441, 442, but equally acts on the first and second pressure receiving surfaces 441, 442 without being affected by the change in the viscosity of the oil due to the external factor. Therefore, deterioration in controllability of the cam ring 4 is suppressed, then good controllability of the cam ring 4 can be ensured.

Further, in the variable displacement oil pump VP2 according to the present embodiment, a flow hole (the spring chamber communication hole 127) through which oil flows is open at the position facing the coil spring SP in the spring accommodating chamber SR.

In particular, the present embodiment is configured so that the spring chamber communication hole 127 is located so as to be shifted to the first and second discharge port 115, 125 side (eccentrically toward the first and second discharge ports 115, 125) which is the discharge side, and a distance between the spring chamber communication hole 127 and the control valve SV' is relatively short. Therefore, response of internal pressure control of the second control hydraulic chamber PR2 is improved, then controllability of the cam ring 4 can be improved.

Further, in the variable displacement oil pump VP2 according to the present embodiment, the spring accommodating chamber SR is open to the air (the atmosphere).

As described above, in the present embodiment, since the spring accommodating chamber SR functioning as the second control hydraulic chamber PR2 is open to the air (the atmosphere), air removal of oil filling the second control hydraulic chamber PR2 is possible. With this, a problem of interfering with the operation (the action) of the cam ring 4 due to the air contained in the spring accommodating chamber SR is suppressed, then proper operation (proper action) of the cam ring 4 can be ensured.

Third Embodiment

Figure 15:
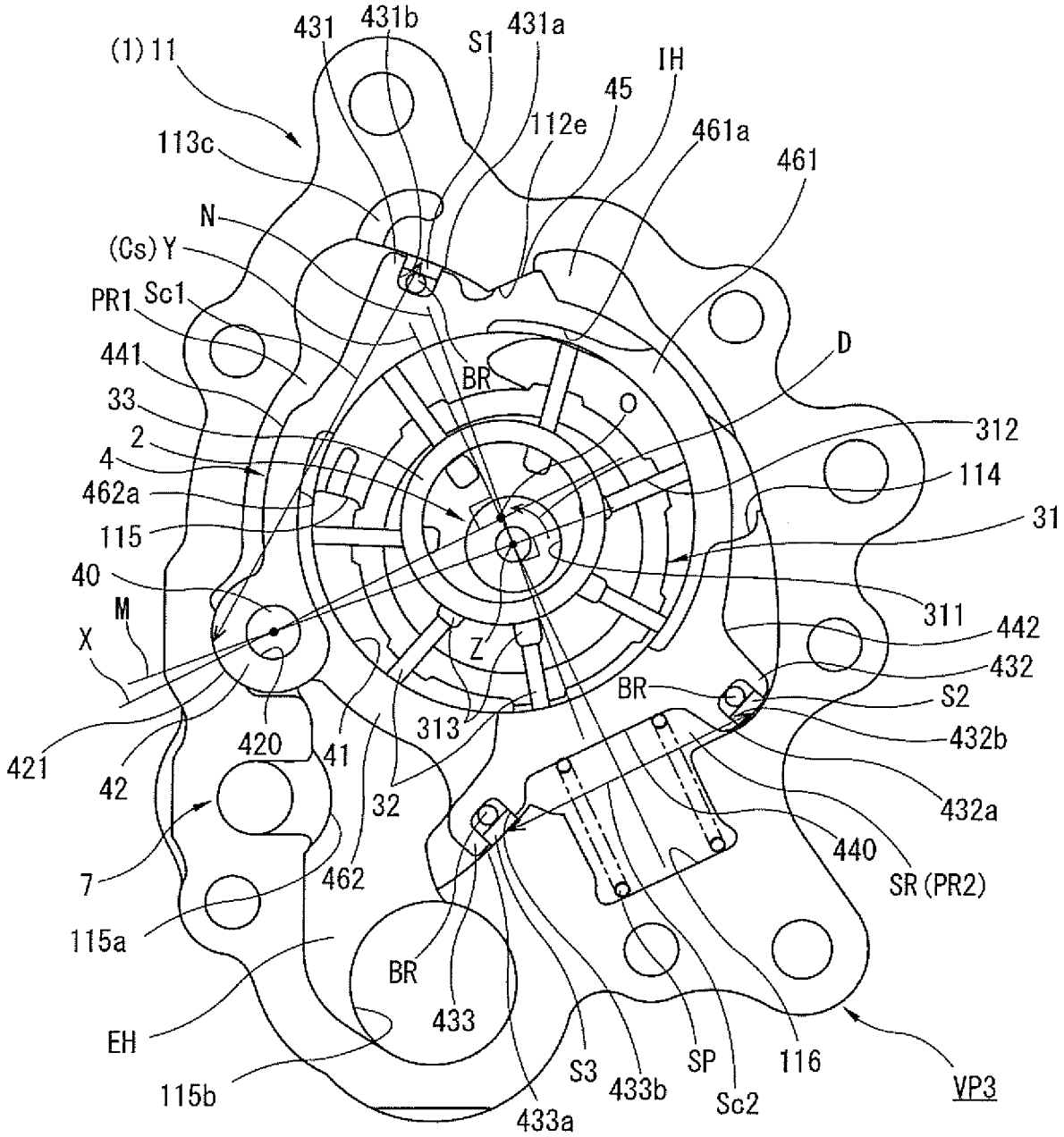
FIG. 15 is a plan view of a variable displacement oil pump according to a third embodiment of the present invention with a second housing removed.

FIG. 15 shows a third embodiment of the variable displacement oil pump according to the present invention. In the third embodiment, configuration of the first pressure receiving surface 441 and the second pressure receiving surface 442 of the first embodiment is changed. The other configurations or structures are the same as those of the first embodiment. Therefore, the same configurations or structures are denoted by the same reference signs, and their descriptions are omitted here.

As illustrated in FIG. 15, in a variable displacement oil pump VP3 according to the present embodiment, an area of the second pressure receiving surface 442 formed between the second seal member S2 and the third seal member S3 is set to be smaller than an area of the first pressure receiving surface 441 formed between the pivot supporting portion 42 and the first seal member S1. In other words, a distance Sc2 between the second seal member S2 and the third seal member S3 is set to be smaller than a distance Sc1 between the pivot supporting portion 42 and the first seal member S1. Further, in the present embodiment, as compared with the first and second embodiments, the suction side chamber IH is enlarged by a size corresponding to reduction in the area of the second pressure receiving surface 442.

As described above, in the variable displacement oil pump VP3 according to the present embodiment, the area of the pressure receiving surface (the second pressure receiving surface 442), facing the spring accommodating chamber SR, of the cam ring 4 is smaller than the area of the pressure receiving surface (the first pressure receiving surface 441), facing the first control hydraulic chamber PR1, of the cam ring 4.

As described above, in the present embodiment, the area of the second pressure receiving surface 442 of the cam ring 4 is set to be smaller than the area of the first pressure receiving surface 441 of the cam ring 4. Therefore, as a region where the first and second suction ports 114, 124 and the inlet 124*a* are formed, i.e. as the suction side chamber IH, a larger suction side chamber IH can be secured by a size corresponding to reduction in the area of the second pressure receiving surface 442, thereby forming a larger suction discharge passage. As a result, a suction performance of the variable displacement oil pump VP3 can be further improved.

Fourth Embodiment

Figure 16:
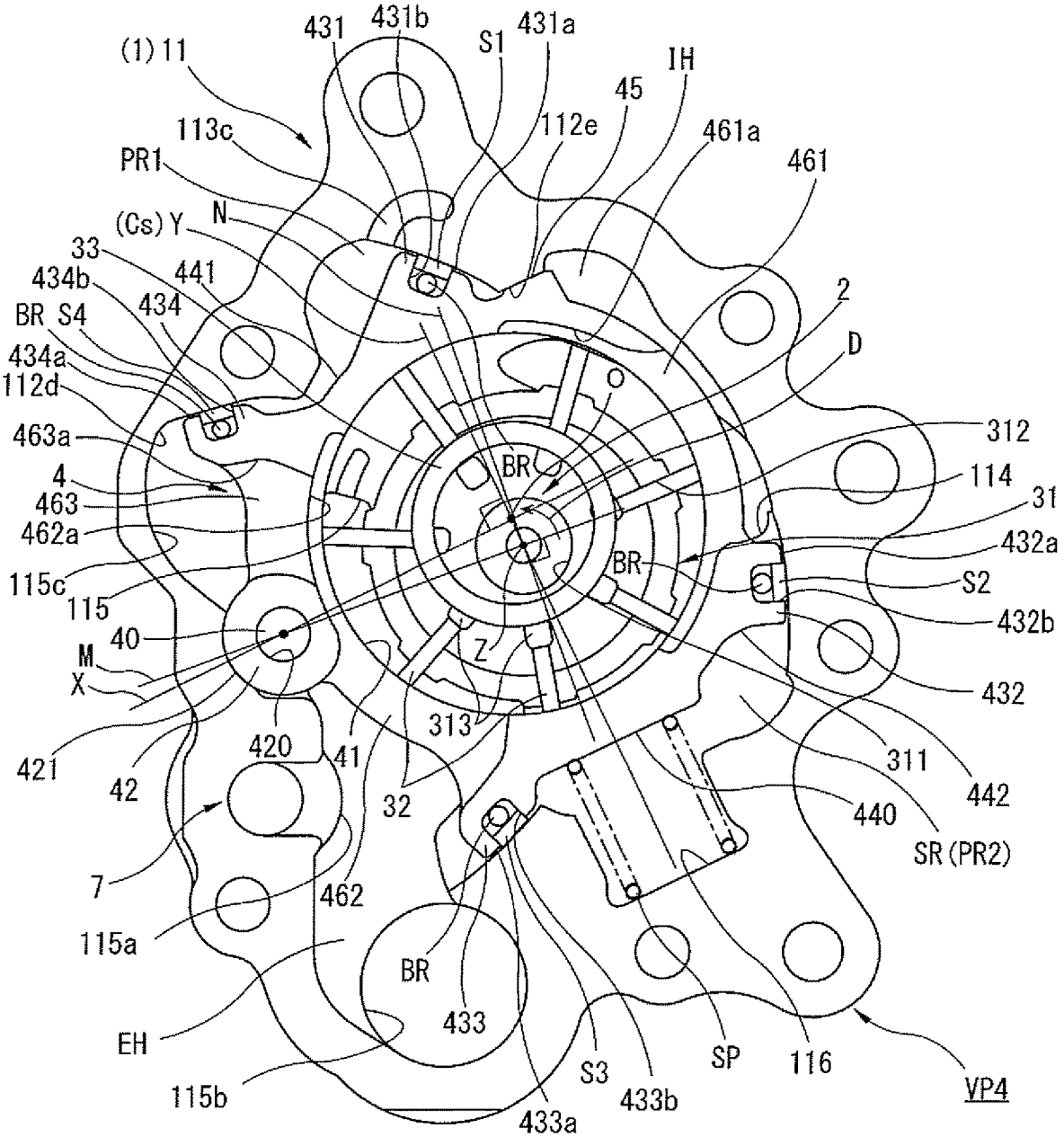
FIG. 16 is a plan view of a variable displacement oil pump according to a fourth embodiment of the present invention with a second housing removed.

FIG. 16 shows a fourth embodiment of the variable displacement oil pump according to the present invention. In the fourth embodiment, configuration of the discharge port extension portion 115*a* of the first embodiment and configuration of the first pressure receiving surface 441 and the second pressure receiving surface 442 of the first embodiment are changed. The other configurations or structures are the same as those of the first embodiment. Therefore, the same configurations or structures are denoted by the same reference signs, and their descriptions are omitted here.

As illustrated in FIG. 16, a variable displacement oil pump VP4 according to the present embodiment has, at the outer circumferential side of the cam ring 4, a fourth seal forming portion 434 facing a fourth seal sliding-contact surface 112*d* provided at the first housing 11, and also has, at the fourth seal forming portion 434, an arc-shaped fourth seal surface 434*a* that is concentric with the fourth seal sliding-contact surface 112*d*. Further, a fourth seal holding groove 434*b* that is open to the fourth seal sliding-contact surface 112*d* side is provided on the fourth seal surface 434*a*.

A fourth seal member S4 coming into sliding-contact with the fourth seal sliding-contact surface 112*d* by or according to pivotal movement (rocking or swinging movement) of the cam ring 4 is accommodated in the fourth seal holding groove 434*b*. The fourth seal member S4 is made of fluororesin material. The fourth seal member S4 elastically contacts the fourth seal sliding-contact surface 112*d* by an elastic force of an elastic member BR made of rubber, and thus a clearance between the fourth seal surface 434*a* and the fourth seal sliding-contact surface 112*d* is liquid-tightly sealed. With this configuration or structure, in the present embodiment, the first control hydraulic chamber PR1 is defined by the first seal member S1 and the fourth seal member S4.

Further, the cam ring 4 has, on an axial direction end surface thereof facing a start end side of the discharge region between the pivot supporting portion 42 and the fourth seal forming portion 434, a discharge side groove forming portion 463 where discharge side cut-out grooves 463*a* through which the pump chambers 30 facing the start end side of the discharge region and the first and second discharge ports 115, 125 can communicate with each other are formed. On the other hand, the first housing 11 is provided, at the bottom wall 111 of the pump accommodating portion 110, with a discharge port extension portion 115*c* formed by extending a start end side of the first discharge port 115 radially outwards. With this, in the present embodiment, a part of oil discharged to the first and second discharge ports 115, 125 is led to the discharge port extension portion 115*c* through the discharge side cut-out grooves 463*a*. This oil led to the discharge port extension portion 115*c* through the discharge side cut-out grooves 463*a* is led to the outlet 115*b* through the first and second discharge ports 115, 125 and the discharge port extension portion 115*a*, and discharged to the discharge passage Le through the outlet 115*b*.

As described above, in the variable displacement oil pump VP4 according to the present embodiment, a volume of the discharge side chamber EH can be enlarged by a size corresponding to the discharge port extension portion 115*c* added to the configuration of the first embodiment. It is therefore possible to improve a discharge performance of the variable displacement oil pump VP4, and thus pump efficiency can be further improved.

Further, in the variable displacement oil pump VP4 according to the present embodiment, the area of the pressure receiving surface (the first pressure receiving surface 441), facing the first control hydraulic chamber PR1, of the cam ring 4 is smaller than the area of the pressure receiving surface (the second pressure receiving surface 442), facing the spring accommodating chamber SR, of the cam ring 4.

In particular, in a case where a relatively large amount of air comes into (or mixed in) the second control hydraulic chamber PR2, such as when cavitation occurs by or according to high rotation speed operation, due to this air, sufficient compression of the oil is not done in the pump chambers 30 located in the discharge region, and the discharge pressure P decreases, and consequently, the internal pressure of the pump chambers 30 in the discharge region becomes unbalanced. More specifically, due to the mixing of the air, hydraulic force forcing the cam ring 4 from the inside of the cam ring 4 to the first control hydraulic chamber PR1 side by the pump chambers 30 in the discharge region decrease, then there is a risk that the cam ring 4 will move to the second control hydraulic chamber PR2 side at an unintended timing (at an earlier timing than an intended timing).

Therefore, as in the present embodiment, by setting the area of the first pressure receiving surface 441 of the cam ring 4 to be smaller than the area of the second pressure receiving surface 442 of the cam ring 4, it is possible to compensate for loss of the internal pressure of the cam ring 4 caused by the mixing of the air, i.e. loss of the hydraulic force forcing the cam ring 4 to the first control hydraulic chamber PR1 side, by the area of the second pressure receiving surface 442 that is set to be relatively large. As a result, proper pivot control of the cam ring 4 during the high rotation speed operation of the variable displacement oil pump VP4 can be achieved.

Fifth Embodiment

Figure 17:
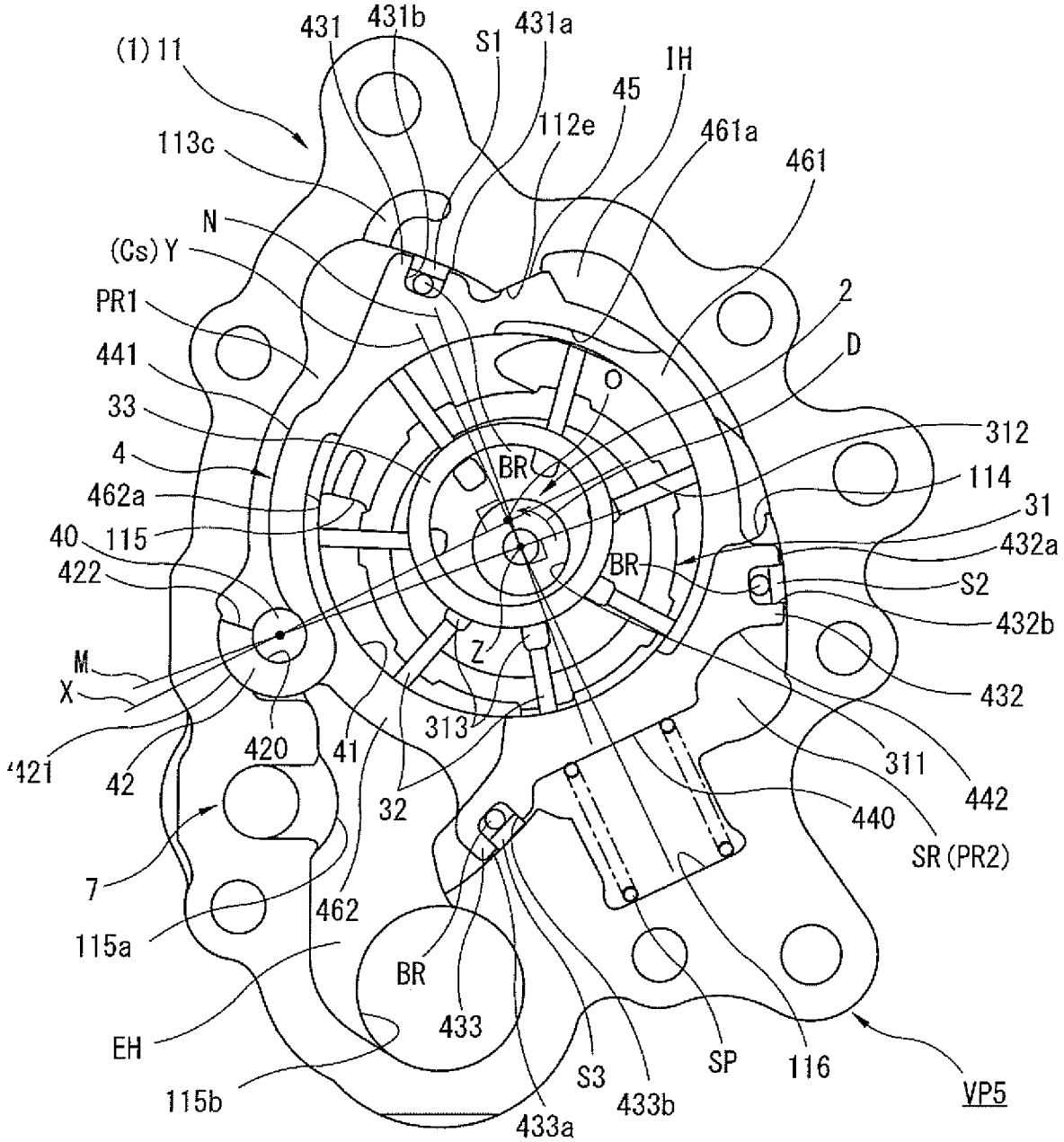
FIG. 17 is a plan view of a variable displacement oil pump according to a fifth embodiment of the present invention with a second housing removed.

FIG. 17 shows a fifth embodiment of the variable displacement oil pump according to the present invention. In the fifth embodiment, structure of the pivot supporting portion 42 of the first embodiment is changed. The other configurations or structures are the same as those of the first embodiment. Therefore, the same configurations or structures are denoted by the same reference signs, and their descriptions are omitted here.

As illustrated in FIG. 17, in a variable displacement oil pump VP5 according to the present embodiment, the pivot supporting portion 42 has, at a part in a circumferential direction of the pivot supporting portion 42, an opening portion 442 through which the pin penetration hole 420 is open to the outside. This opening portion 442 is provided at the pivot supporting portion 42 throughout its axial direction so as to have a width that is greater than an outside diameter of the pivot pin 40 and be open to the radially outer side. That is, in the present embodiment, since a part of an outer circumferential portion of the pivot pin 40 faces the outside of the cam ring 4 through the opening portion 442, a relative movement of the cam ring 4 with respect to the pivot pin 40 can be allowed.

As described above, the variable displacement oil pump VP5 according to the present embodiment is configured so that the first control hydraulic chamber PR1 is liquid-tightly sealed by the pivot (the pivot pin 40) of the cam ring 4 and the seal member (the first seal member S1) attached to the cam ring 4, and the cam ring 4 covers a part of the circumference of the pivot supporting portion 42 in the moving direction of the cam ring 4.

As described above, in the present embodiment, the opening portion 442 is provided at a part in the circumferential direction of the pivot supporting portion 42, and by the opening portion 442, a part of the circumference of the pivot pin 40 forming the pivot of the cam ring 4 is not covered. With this structure, a relative movement of the cam ring 4 with respect to the pivot pin 40 can be allowed at the opening portion 442. With this, restraint of the cam ring 4 in a state in which the cam ring 4 is assembled to the pivot pin 40 is relaxed, thereby improving workability of assembling the first seal member S1 to the cam ring 4.

The present invention is not limited to the configurations or structures of the above embodiments. For instance, the present invention can be freely modified according to specifications of the engine of the vehicle or the valve timing control device on which any of the variable displacement oil pumps VP1 to VP5 is mounted.

Further, each of the embodiments shows an example in which a so-called pivoting cam ring 4 (rocking or swinging cam ring 4) that variably changes a discharge amount of the pump by pivoting the cam ring 4 is used. However, as a means of variably changing the discharge amount of the pump, it is not limited to the pivoting cam ring 4. For instance, it could be done by moving (sliding) the cam ring 4 linearly in the radial direction. In other words, as long as the pump discharge amount can be varied (the volume variation of the pump chamber 30 can be varied), configuration of the movement of the cam ring 4 is not limited.

Furthermore, in the above embodiments, since the present invention is applied to a vane-type variable displacement oil pump, the cam ring 4 corresponds to the adjusting member according to the present invention. However, the variable displacement oil pump is not limited to the vane-type variable displacement oil pump, but the present invention could be applied to other variable displacement oil pumps, such as a trochoid-type pump. It is noted that when the present invention is applied to the trochoid-type pump, an outer rotor forming an external gear corresponds to the adjusting member.

The invention claimed is:

1. A variable displacement oil pump comprising:

a housing having a pump accommodating portion;

an adjusting member provided in the pump accommodating portion so as to be able to pivot on a pivot as a rotation shaft that is provided at the pump accommodating portion;

a pump member accommodated inside the adjusting member and driven and rotated by a drive shaft passing through a rotation center that is eccentric to a center of an inner circumference of the adjusting member, wherein a plurality of working chambers are defined between the pump member and the adjusting member, oil is sucked into some working chambers of the plurality of working chambers through a suction portion that is provided so as to straddle the adjusting member in a radial direction of the drive shaft according to rotation of the pump member, and oil in the some working chambers of the plurality of working chambers is discharged through a discharge portion that is provided so as to straddle the adjusting member in the radial direction according to the rotation of the pump member;

a first control hydraulic chamber formed between the pump accommodating portion and the adjusting member in the radial direction, wherein a volume of the first control hydraulic chamber increases when oil discharged from the discharge portion is led to the first control hydraulic chamber and the adjusting member moves in a direction in which an eccentric amount of the center of the inner circumference of the adjusting member from the rotation center of the drive shaft decreases; and an urging member forcing the adjusting member in a direction in which the eccentric amount of the center of the inner circumference of the adjusting member from the rotation center of the drive shaft increases by contacting the adjusting member, wherein the urging member is provided between the pump accommodating portion and the adjusting member and located at a position that faces the drive shaft in the radial direction and that does not overlap the suction portion when viewed from an axial direction along the drive shaft, wherein the urging member is accommodated in an urging member accommodating chamber liquid-tightly sealed between the pump accommodating portion and the adjusting member, and a distance between a discharge side seal portion liquid-tightly sealing a clearance between the discharge portion and the urging member accommodating chamber and a center of the urging member is shorter than a distance between a suction side seal portion liquid-tightly sealing a clearance between the suction portion and the urging member accommodating chamber and the center of the urging member.

2. The variable displacement oil pump as claimed in claim 1, wherein the urging member accommodating chamber communicates with the discharge portion through a control mechanism, or communicates with a low pressure part whose pressure is lower than that of the discharge portion.

3. The variable displacement oil pump as claimed in claim 2, wherein a flow hole through which oil flows is open at a position facing the urging member in the urging member accommodating chamber.

4. The variable displacement oil pump as claimed in claim 2, wherein an area of a pressure receiving surface of the urging member accommodating chamber is smaller than an area of a pressure receiving surface of the first control hydraulic chamber.

5. The variable displacement oil pump as claimed in claim 1, wherein the urging member accommodating chamber is open to atmosphere.

6. The variable displacement oil pump as claimed in claim 1, further comprising:

a suction discharge passage that is a passage formed separately from the first control hydraulic chamber and connecting from the suction portion to the discharge portion through the plurality of working chambers, wherein the suction discharge passage is provided between the first control hydraulic chamber and the urging member accommodating chamber.

7. The variable displacement oil pump as claimed in claim 1, wherein a contact surface of the adjusting member with the urging member is parallel to a line connecting the pivot of the adjusting member and the rotation center of the drive shaft in a state in which the center of the inner circumference of the adjusting member is eccentric to the rotation center of the drive shaft.

8. The variable displacement oil pump as claimed in claim 7, wherein the contact surface of the adjusting member with the urging member is parallel to a line connecting the pivot of the adjusting member and the rotation center of the drive shaft in a state in which the center of the inner circumference of the adjusting member is most eccentric to the rotation center of the drive shaft.

9. The variable displacement oil pump as claimed in claim 1, wherein the urging member forces the adjusting member toward the drive shaft.

10. The variable displacement oil pump as claimed in claim 1, wherein the adjusting member is formed so as to surround an entire circumference of the pivot in a moving direction of the adjusting member.

11. The variable displacement oil pump as claimed in claim 1, wherein the first control hydraulic chamber is liquid-tightly sealed by the pivot of the adjusting member and a seal member attached to the adjusting member, and the adjusting member covers a part of a circumference of the pivot in a moving direction of the adjusting member.

* * * * *